US007086535B2

(12) United States Patent
Stencel et al.

(10) Patent No.: US 7,086,535 B2
(45) Date of Patent: Aug. 8, 2006

(54) PARTICLE SEPARATION/PURIFICATION SYSTEM, DIFFUSER AND RELATED METHODS

(75) Inventors: John M. Stencel, Lexington, KY (US); Tapiwa Zabron Gurupira, Lexington, KY (US)

(73) Assignee: University of Kentucky Research Foundation, Lexington, KY (US)

( * ) Notice: Subject to any disclaimer, the term of this patent is extended or adjusted under 35 U.S.C. 154(b) by 83 days.

(21) Appl. No.: 10/438,376

(22) Filed: May 15, 2003

(65) Prior Publication Data

US 2003/0213729 A1 Nov. 20, 2003

Related U.S. Application Data

(60) Provisional application No. 60/378,118, filed on May 15, 2002.

(51) Int. Cl.
*B03C 7/00* (2006.01)

(52) U.S. Cl. ..... 209/12.2; 209/128; 96/73; 95/23; 95/78

(58) Field of Classification Search ..... 96/3, 96/70, 73; 95/23, 78; 55/DIG. 38; 209/12.2, 209/39, 128, 129, 130, 131, 134, 135, 232
See application file for complete search history.

(56) References Cited

U.S. PATENT DOCUMENTS

| | | | | |
|---|---|---|---|---|
| 1,071,354 A | | 8/1913 | Schnelle | |
| 2,216,254 A | | 10/1940 | Schweitzer, Jr. | |
| 2,334,540 A | | 11/1943 | Buffham | |
| 2,937,875 A | | 5/1960 | Mason et al. | |
| 3,154,682 A | * | 10/1964 | Hartz et al. | 95/78 |
| 3,191,630 A | | 6/1965 | Demyan | |
| 3,366,388 A | | 1/1968 | Del Raso | |
| 3,493,109 A | | 2/1970 | Carta et al. | |
| 3,853,750 A | | 12/1974 | Volsy | |
| 4,137,156 A | * | 1/1979 | Morey et al. | 209/212 |
| 4,207,083 A | | 6/1980 | Gelhaar et al. | |
| 4,790,538 A | | 12/1988 | Gettelfinger | |
| 4,839,032 A | | 6/1989 | Whitlock | |
| 4,874,507 A | | 10/1989 | Whitlock | |
| 4,943,368 A | | 7/1990 | Gilbert et al. | |
| 5,046,741 A | | 9/1991 | Ahn | |
| 5,333,876 A | | 8/1994 | Goto | |
| 5,431,403 A | | 7/1995 | Pelz | |

(Continued)

OTHER PUBLICATIONS

*PuttGolf™ Adjustable Indoor Putting Green* Set-Up Instructions, p. 1-7, Sep. 2000.

(Continued)

*Primary Examiner*—Donald P. Walsh
(74) *Attorney, Agent, or Firm*—King & Schickli, PLLC

(57) ABSTRACT

A separator for intended use in separating particles having a selected charge from a particle mixture entrained in or carried by a fluid flow is disclosed. The separator comprises a tubular, elongated body for receiving the fluid flow. At least one and preferably a pair of electrodes may be provided to create an electric field in at least a portion of the body through which the fluid flow passes, and at least one partition defines first and second channels for receiving the flow downstream of the portion of the body including the electric field. In one embodiment, the electrode is oriented such that a direction of an electrical field force acting on particles having a selected charge passing through the electric field is not perpendicular to a direction of gravity. A system incorporating the separator is disclosed, along with a diffuser and related methods.

44 Claims, 14 Drawing Sheets

U.S. PATENT DOCUMENTS

| | | | | |
|---|---|---|---|---|
| 5,518,245 | A | 5/1996 | Nelson | |
| 5,755,333 | A | 5/1998 | Stencel et al. | |
| 5,885,330 | A | 3/1999 | Lee | |
| 5,938,041 | A | 8/1999 | Stencel et al. | |
| 5,944,875 | A | 8/1999 | Stencel et al. | |
| 6,074,458 | A | 6/2000 | Bittner et al. | |
| 6,090,189 | A * | 7/2000 | Wikstrom et al. | 96/69 |
| 6,146,284 | A | 11/2000 | Russell | |
| 6,163,098 | A * | 12/2000 | Taylor et al. | 310/308 |
| 6,323,451 | B1 | 11/2001 | Stencel et al. | |
| 6,398,848 | B1 | 6/2002 | Ridgeway et al. | |
| 6,498,313 | B1 | 12/2002 | Stencel et al. | |

OTHER PUBLICATIONS

Ban, H., "An Experimental Study of Particulate Charge Relating to Electrostatic Dry Coal Cleaning", Ph.D Dissertation, University of Kentucky, 1994.

Kyper, T.N., Brendel, G.F., Golden, D.M., "Institutional Constraints to the Beneficial Use of Coal Fly Ash", Proc. Tenth Intn'l Ash Use Sym., vol. 2: Ash Use R&D/Clean Coal By-Products, Jan. 1993.

Cochran, J.W., Boyd, T.J., "Benefication of Fly Ash by Carbon Burnout", Proc. Tenth Intn'l Ash Use Sym., vol. 2: Ash Use R&D/Clean Coal By-Products, Jan. 1993.

Gurupira, T. Z., C. L. Jones, A. Howard, C. Lockert, T. Wandell and J. M. Stencel, "New Products from Coal Combusion Ash: Selective Extraction of Particles with Density < 2", 2001/InternationalAsh Symposium, Lexington, KY, 2001.

Ghosal, S., S. A. Self, "Particle Size-Density Relation and Cenosphere Content of Coal Fly Ash", Fuel, vol. 74, No. 4, pp. 522-529, (1995).

Benson, S.A., Jones, M.L., Harb, J.N.., "Ash Formation and Deposition", Fundamentals of Coal Combusion, ed. L.D. Smoot, (Elsevier, 1993) pp. 299-373.

Hower, J.C., Robl, T.L., "Production of Coal-Combustion By-Products in Kentucky: Trends and Prospects", J. Coal Quality, Jan.-Mar. 1993.

Butler, W.B., Mearing, M.A., "Fly Ash Beneficiation and Utilization in Theory and in Practice", Fly Ash and Coal Conversion By-Products: Characterization, Utilization and Disposal II, Proc. Mat. Res. Soc. Sym., Dec. 2-4, 1985, ed. G.J. McCarthy, F.P. Glasser, D.M. Roy, (Materials Research Society, 1986) pp. 11-17.

T.L. Robl, J. Hower, U. Graham and R. Rathbone, Proc., "Influence of Conversion to Low NOX Combustion on Fly Ash Petrology and Mineralogy", 12th Ann. Intn'l. Pitts. Coal Conf., Sep. 11-15, 1995, pp. 121-125.

Gibbins, J.R.., Williamson, J., "The Origin of Unburnt Carbon in Pulverized Fuel Ash", Intn'l. Conf. on Coal Science, Banff, Alberta, Canada, Sep. 12-17, 1993.

Ciccu, R., Peretti, R., Serci, A., Tamanini, M., Zucca, A., "Experimental Study on Triboelectric Charging of Mineral Particles", J. Electrostatics, vol. 23, pp. 157-168, 1989.

Kelly, E.G., Spottiswood, D.J., "The Theory of Electrostatic Separation: A Review, Part II. Pariicle Charging", Minerals Engineering, vol. 2, No. 2, pp. 193-205, 1989.

Ciccu, R., G. Alfano, P. Carbini, M. Ghiani, N. Passarini, R. Peretti and A. Zucca, "Ore and Coal Processing with the Turbocharger Electrostatic Separator," Proc. Int't Sym. Adv. Fine Particle Proc., Advances in Fine Particle Proc. (Elsevier, New York), 1990.

Ciccu, R., M. Ghiani and G. Ferrara, "Selective Tribocharging of Particles for Separation," Powder and Particles, No. 11, 5 (1993).

Whitlock, D.R., "Electrostatic Separation of Unburned Carbon from Fly Ash", Proc. 10th Int'l. Ash Use Sym., vol. 2: Ash Use R&D and Clean Coal By-Products, Jan. 1993.

* cited by examiner

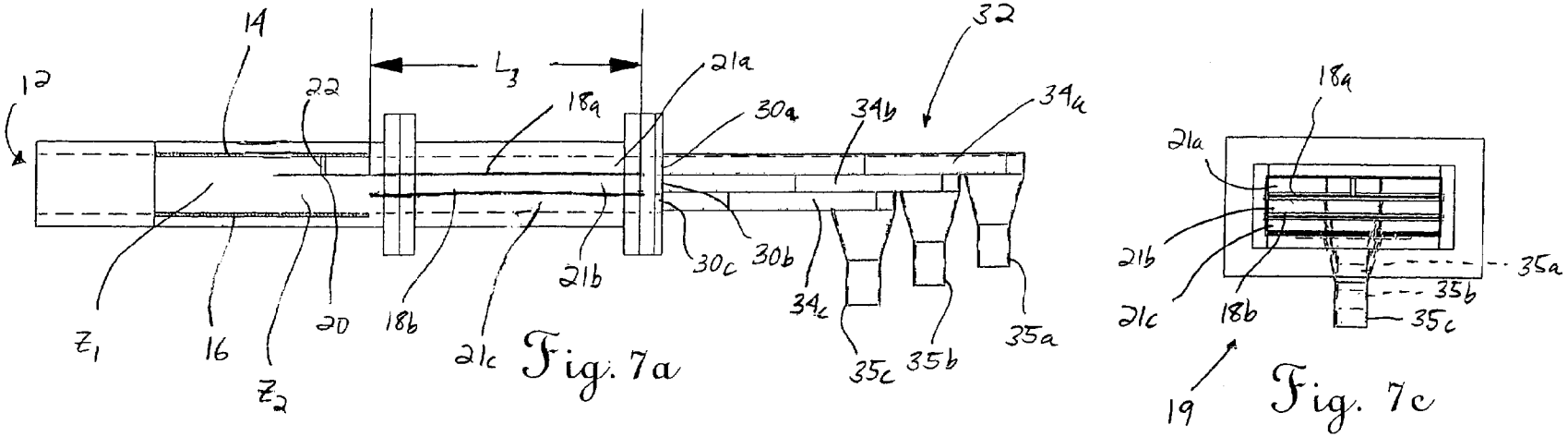
Fig. 7c
Fig. 7a
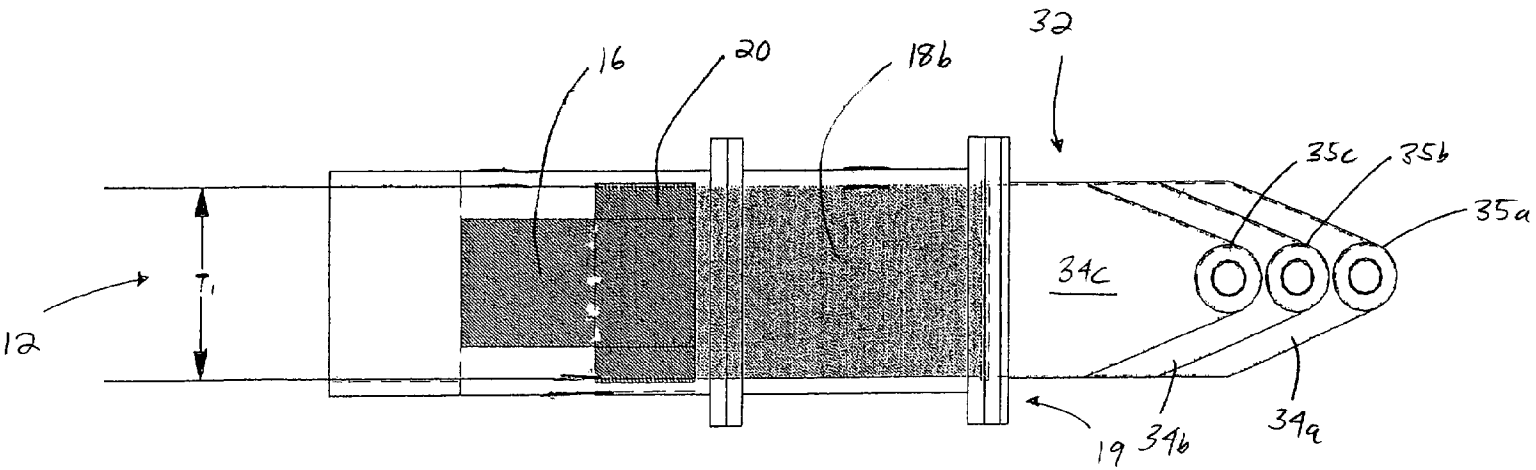
Fig. 7b

PARTICLE SEPARATION/PURIFICATION SYSTEM, DIFFUSER AND RELATED METHODS

This application claims the benefit of U.S. Provisional Patent Application Ser. No. 60/378,118, filed May 15, 2002, the disclosure of which is incorporated herein by reference.

TECHNICAL FIELD

The present invention relates generally to the material separation or purification arts and, more particularly, to a particle separation/purification system including a non-vertically oriented separator, a diffuser capable of use with such a system, and related methods.

BACKGROUND OF THE INVENTION

The separation or purification of physical mixtures of fine particles (called "beneficiation" in the vernacular) is accomplished primarily by establishing a bipolar charge on the constituent particle species and then using mechanical or gas conveyance to move the particles through selectively charged electrical fields. In the example of the typical arrangement shown in the schematic diagram of FIG. 1, the particles (only one oversized particle P shown for purposes of illustration) are carried by or entrained in a gaseous medium and passed through a diffuser R (including possibly with a co-flow of gas G devoid of particles) such that the direction of conveyance or flow direction F, is generally parallel to the direction of gravity (Y-axis or direction), or "vertical." One or more electrodes (usually elongated plates, not shown) positioned adjacent to the flow create the electric field E to effect separation of particles having a selected charge (either positive or negative, depending on the charge on the electrode, but shown as having a like charge in FIG. 1) by deflecting them. In the usual arrangement, the electrode(s) are positioned such that a direction of the electric field force $F_e$ is applied perpendicular to the flow direction F (that is, aligned with the X-axis or direction in FIG. 1, or the horizontal plane). As a result, the particle P having the selected charge is deflected in the X-direction and its trajectory T changes as it travels through this electric field "zone," such that it may be selected out of or separated from the flow stream and collected.

Generally speaking, Newton's Laws of classical mechanics govern the motion of charged particles having diameters near or greater than atomic dimensions. Consequently, when suspended or entrained in a gas and under the influence of an electric field and gravity, the principle forces acting on a particle (assuming laminar flow, Stokes drag, no image force and Brownian motion) include:

(1) gravitational force ($F_g$=mg); [1.1]

(2) electric field force ($F_e=qE$); [1.2]

(3) viscous force ($F_x=6\mu\pi rV$); and [1.3]

(4) inertial force ($F_i=m(dV/dt)$), [1.4]

where:

E=electric field strength
μ=viscosity of medium
V=particle velocity
g=acceleration due to gravity
y=direction perpendicular to the electric field
q=charge on the particle r=radius of the particle
m=mass of the particle
x=direction parallel to the electric field Summing up the forces for a vertically oriented separation system in which the gravitational force is in the Y-direction (see FIG. 2), the following is obtained:

$$\Sigma F_x=F_e-F_{\mu(x)}-F_{i(x)}=0 \quad [1.5]$$

$$\Sigma F_y=F_g-F_{i(y)}=0 \quad [1.6]$$

In the X-direction, the forces are:

$$F_e-F_{\mu(x)}-F_{i(x)}=0 \quad [1.7]$$

Substitution from Equations 1.1, 1.2, 1.3 and 1.4 into Equation 1.7 yields:

$$qE-6\pi r\mu V_x-m\frac{dV_x}{dt}=0 \quad [1.8]$$

In the Y-direction:

$$F_g-F_{i(y)}=0 \quad [1.9]$$

Substitution yields:

$$mg-m\frac{dV_y}{dt}=0 \quad [1.10]$$

Consequently, when oriented in the vertical orientation such that a direction of the electric field force $F_e$ is perpendicular to the direction of gravity (Y-direction), only this force acts to deflect or move the charged particle P in the X-direction. The viscous force and inertial force actually oppose this deflection, rather than assist it.

Accordingly, a need is identified for a separation/purification systems where the forces present, including the gravitational force acting on the particles, are used to advantage, including for separating lower density particles considered impurities from higher density particles in a particle mixture.

SUMMARY OF THE INVENTION

In accordance with a first aspect ofthe invention, a separator for intended use in at least partially separating at least one species of selectively charged particles from a particle mixture carried by a fluid flow is disclosed. In one embodiment, the separator comprises a tubular, elongated body for receiving the fluid flow and a first electric field for deflecting the selectively charged particles in at least a portion of the body through which the fluid flow passes, and a first partition defining first and second channels adapted for receiving first and second portions of the fluid flow after entering the first electric field, with at least one of the portions of the fluid flow including selectively charged particles deflected by the first electric field. To take advantage of the influence of gravity of the particles, the electric field is created such that a direction of an electric field force acting on the selectively charged particles passing through the first electric field is not perpendicular to a direction of gravity. In a most preferred embodiment, the direction of the electric field force is aligned with and generally parallel to the direction of gravity and generally perpendicular to a direction of fluid flow through the body. An angle between the direction of the electric field force and the direction of gravity may be acute.

Preferably, first and second electrodes are positioned in or adjacent to the body for creating the first electrical field. The separator may further include a third electrode positioned between the first and second electrodes for creating a second electric field with one of the first and second electrodes. The third electrode may be electrically coupled or connected to one of the first and second electrodes, and a second partition may define a third channel for receiving a third portion of the fluid flow, including selectively charged particles deflected by the third electrode. One of the first and second electrodes includes a longitudinal dimension, and a corresponding dimension of the third electrode is preferably less than the longitudinal dimension of the first or second electrode. The third electrode may be supported by one of the body, the first electrode, and the second electrode.

The separator may further include a manifold having first and second passageways corresponding to the first and second channels defined by the first partition, each passageway being in communication with a pipe for delivering the particles received in the channel to a collector. Preferably, at least one of the first and second passageways includes a non-circular inlet for matching an outlet end of the corresponding channel and a circular outlet for matching with an inlet end of the pipe. The separator may also include a diffuser for positioning in or adjacent to an inlet end of the body to introduce the particle mixture to the electric field, as well as a flow straightener positioned in the inlet end of the body adjacent to the diffuser and adapted for receiving a second flow of fluid devoid of particles.

In another embodiment, at least some of the particles in the particle mixture are ferromagnetic, and the separator further includes a magnet for creating a magnetic field-in at least a portion of the body through which the fluid flow passes for attracting or repelling the ferromagnetic particles.

In accordance with another aspect of the invention, a system for electrostatically separating a first species of selectively charged particles from a particle mixture is disclosed. The system comprises a feeder for supplying the particle mixture and a pressurized driving fluid source for supplying a driving fluid for carrying the particle mixture supplied by the feeder. A separator comprising a tubular, elongated body for receiving the driving fluid carrying the particle mixture and a first electric field in at least a portion of the body through which the driving fluid passes for deflecting the selectively charged particles is provided. In the separator, at least one partition defines first and second channels for receiving first and second portions of the driving fluid after entering the first electric field. The electric field is created such that a direction of an electrical field force acting on the selectively charged particles passing through the first electric field is not perpendicular to a direction of gravity. The system further includes a first collection device for receiving particles collected in the first channel, a second collection device for receiving particles collected in the second channel, and an induction source in fluid communication with the first and second collection devices for drawing the driving fluid through the system.

In accordance with a third aspect of the invention, a separator for intended use in separating a selected species of particles having a particular charge from a particle mixture carried by a fluid flow is disclosed. The separator comprises a tubular, elongated body for receiving the fluid flow. First and second electrodes are positioned in or adjacent to the body for creating a first electric field for deflecting the selectively charged particles in a portion of the body receiving the fluid flow. A third electrode positioned between the first and second electrodes together with one of the first and second electrodes creates a second electric field adjacent to the first electric field for deflecting the selectively charged particles. The third electrode includes a longitudinal dimension in a direction of fluid flow less than a corresponding dimension of the first or second electrode in the same direction.

In accordance with a fourth aspect of the invention, a diffuser assembly for receiving a fluid medium, such as a gas, and creating a spray having an elongated profile or flow pattern is disclosed. The diffuser comprises a body including a top wall, a bottom wall, and a pair of spaced sidewalls defining an inlet and an outlet. A tubular nozzle associated with the inlet of the body includes a generally circular portion adapted for receiving the fluid medium and a frusto-conical portion extending at least partially along the body toward the outlet for delivering the fluid medium to the body. The top wall, bottom wall, and spaced sidewalls define a passageway having a generally rectangular cross-section and an elongated, generally rectangular opening adjacent to the outlet through which the fluid medium passes after exiting the nozzle to form the spray having the elongated profile.

In one embodiment, each sidewall includes a first portion forming an acute angle relative to a second portion thereof. The angle between the first portion and the second portion of each sidewall may be about 15° or less. Preferably, the first portions of the sidewalls of the body are divergent adjacent to the frusto-conical portion of the nozzle and generally parallel downstream of the nozzle. Also, a value of a first dimension measured from an end of the frusto-conical portion of the nozzle adjacent to the circular portion to the outlet of the body divided by a second dimension measured from the top wall to the bottom wall of the body is preferably greater than about 20.

In another embodiment, the angle between the first portion and the second portion is about 15° or greater. The sidewalls are spaced apart a first dimension, and the top and bottom walls are spaced apart a second dimension at the interfaces with the sidewalls and a third dimension at a midpoint between the sidewalls. The third dimension is up to about 15% greater than the second dimension. Consequently, the top and bottom walls are generally V-shaped, with the apex of each wall being located at approximately a midpoint between the sidewalls.

In another embodiment, the angle between the first portion and the second portion is about 15° or greater. The sidewalls are spaced apart a first dimension, and the top and bottom walls are spaced apart a second dimension at the interfaces with the sidewalls and a third dimension at about one-quarter and about three-quarters of the first dimension. The third dimension is up to about 15% greater than the second dimension. Consequently, the top and bottom walls are generally W-shaped, with a first apex of each wall provided at a first location approximately one-quarter of the distance between the sidewalls and a second apex provided at a second location approximately three-quarters of the distance between the sidewalls.

In accordance with a fifth aspect of the invention, a method of separating at least one species of selectively charged particles from a mixture of particles entrained in or carried by a fluid flow is disclosed. The method comprises: (1) passing the fluid flow through a first electric field formed in a portion of a tubular, elongated body, wherein a direction of the electric field force acting on selectively charged particles in the mixture is not perpendicular to a direction of gravity; (2) dividing the fluid flow passing the electric field into a first portion including selectively charged particles deflected after entering the electric field and a second portion; and (3) collecting at least the selectively charged particles in at least the first portion of the fluid flow.

In the case where a direction of the electric field force is generally parallel to the direction of gravity, the method may further include the steps of: (1) providing a first species of particles in the mixture having a size, mass, or density less than that a second species of particles in the mixture; and (2) creating the electric field such that the first species of particles are deflected opposite the direction of gravity. The step of creating the electric field may comprise providing an upper electrode positioned above the fluid flow in the body with a charge opposite that of a charge on the first species of particles, or may comprise providing a lower electrode below the fluid flow in the body with a charge that is the same as a charge on the first species of particles.

The method may further include the steps of providing first and second spaced electrodes in or adjacent to the body for creating the first electric field and providing a third electrode between the first and second electrodes. The third electrode may be electrically coupled or connected to one of the first or second electrodes to create a second electric field with the other of the electrodes. The step of providing at least two partitions dividing the body into first, second, and third channels adjacent to the first and second electric fields may also be performed. In this method, a first channel receives a first portion of the fluid flow including particles deflected by the first electrode, the second channel receives a second portion of the fluid flow including particles deflected by the second electrode, and the third channel receives a third portion of the fluid flow including particles deflected by the third electrode. The step of collecting the selectively charged particles includes collecting the particles in the third portion of the fluid flow.

BRIEF DESCRIPTION OF THE DRAWINGS

FIGS. 7*a*–7*d* are side, bottom, end, and perspective views of a separator with a manifold for delivering product from the separator to separate pipes;

DETAILED DESCRIPTION OF THE INVENTION

Figure 1:
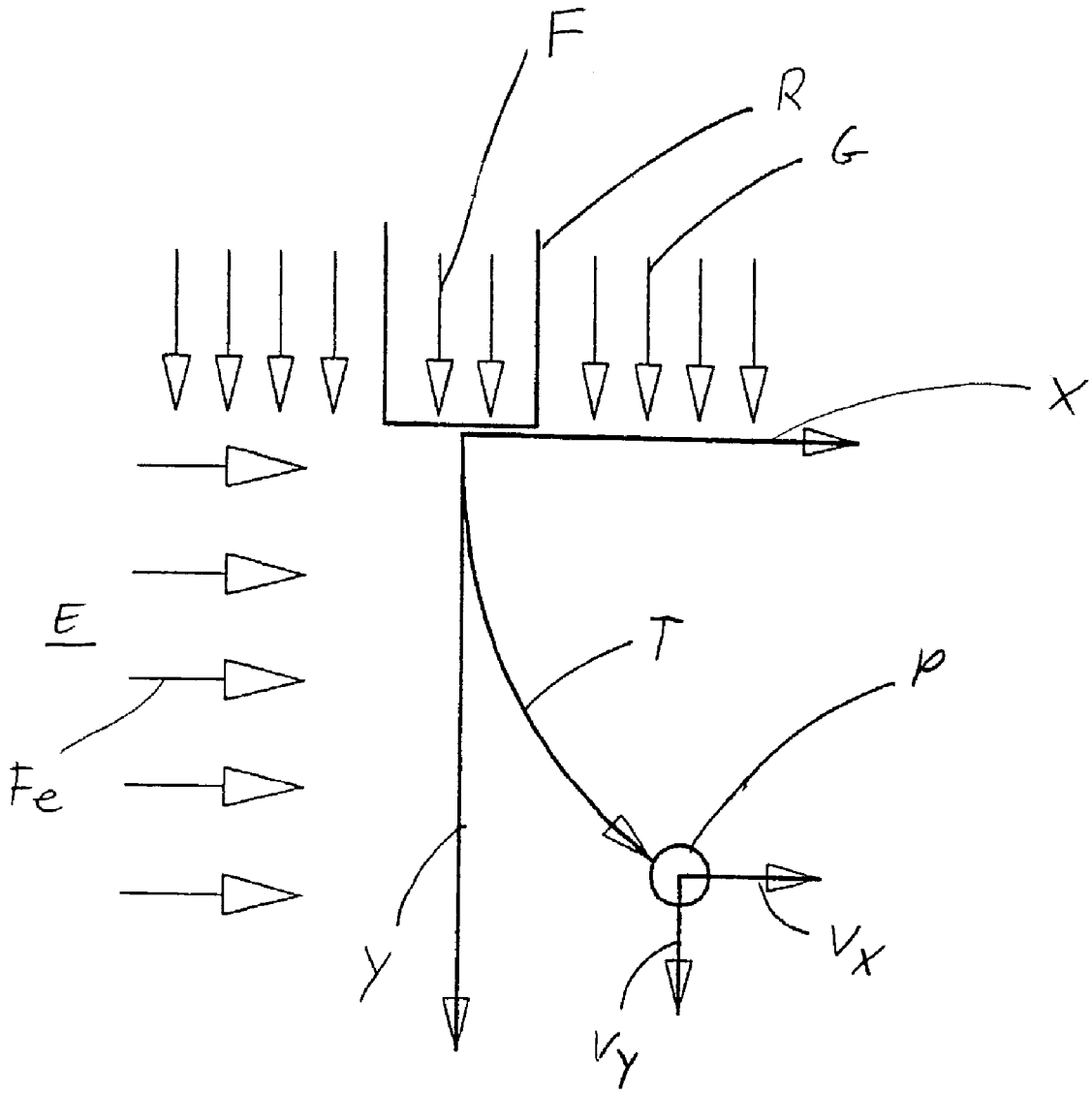
Fig. 1 (prior art)
FIG. 1 is a schematic diagram of a typical prior art particle separation/purification arrangement in which a direction of the electric field force is perpendicular to a direction of gravity.
Figure 2:
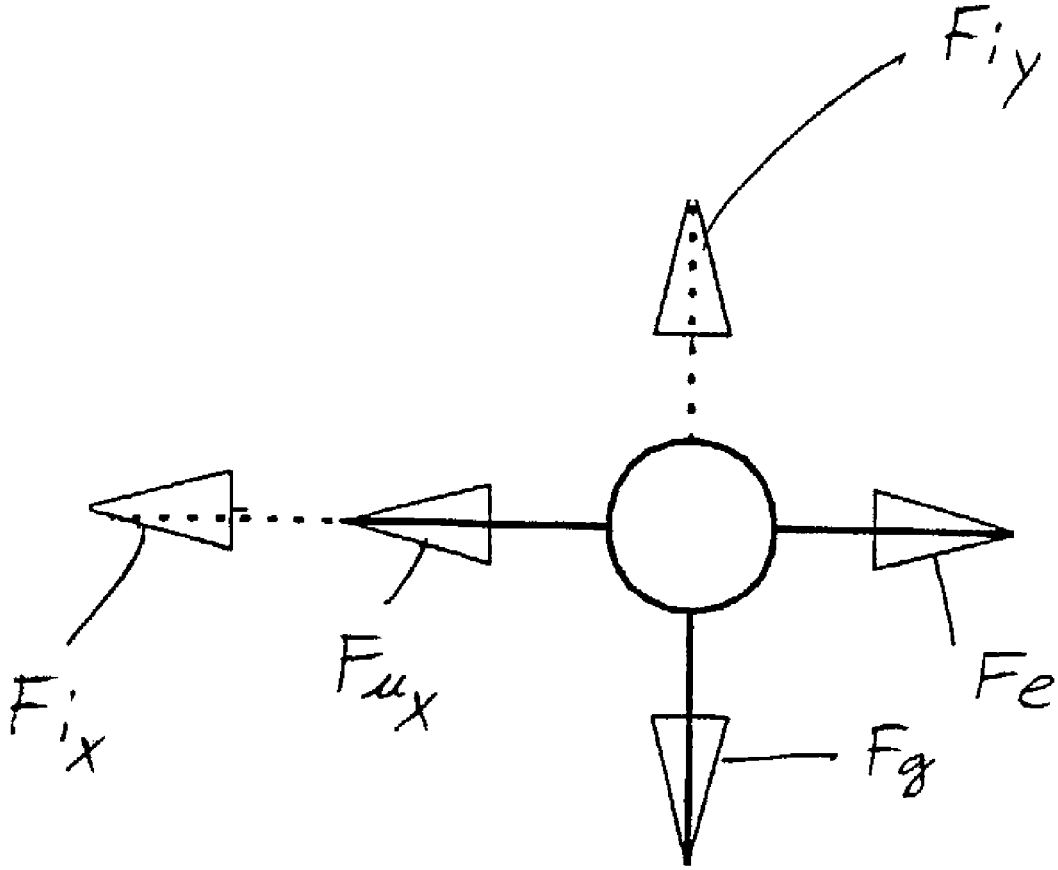
Fig. 2 (prior art)
FIG. 2 is a diagram illustrating the forces acting on the particle shown in FIG. 1.
Figure 3:
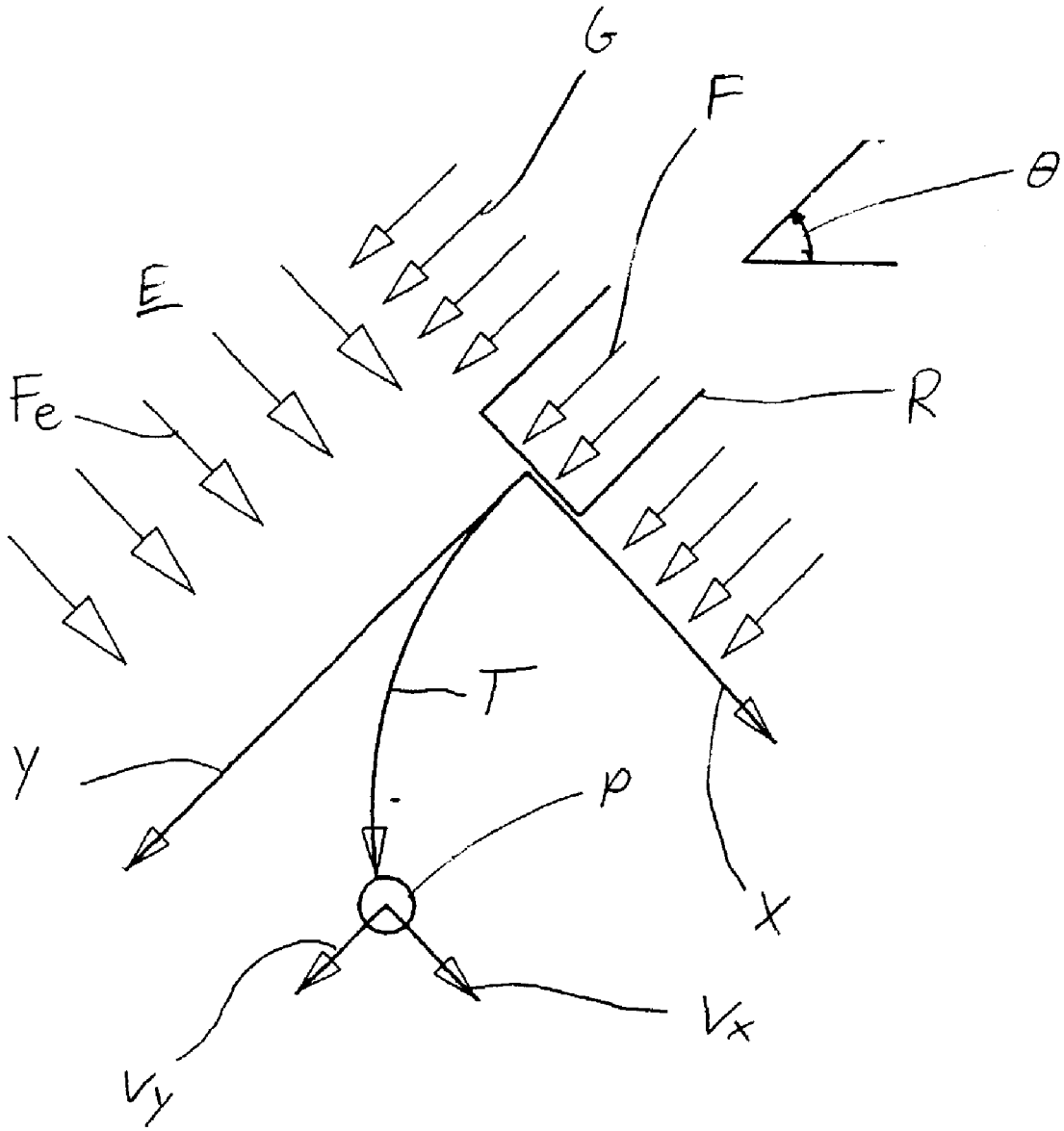
FIG. 3 is a schematic diagram of a separator in which a direction of the electric field force is not perpendicular to a direction of gravity.
Figure 4:
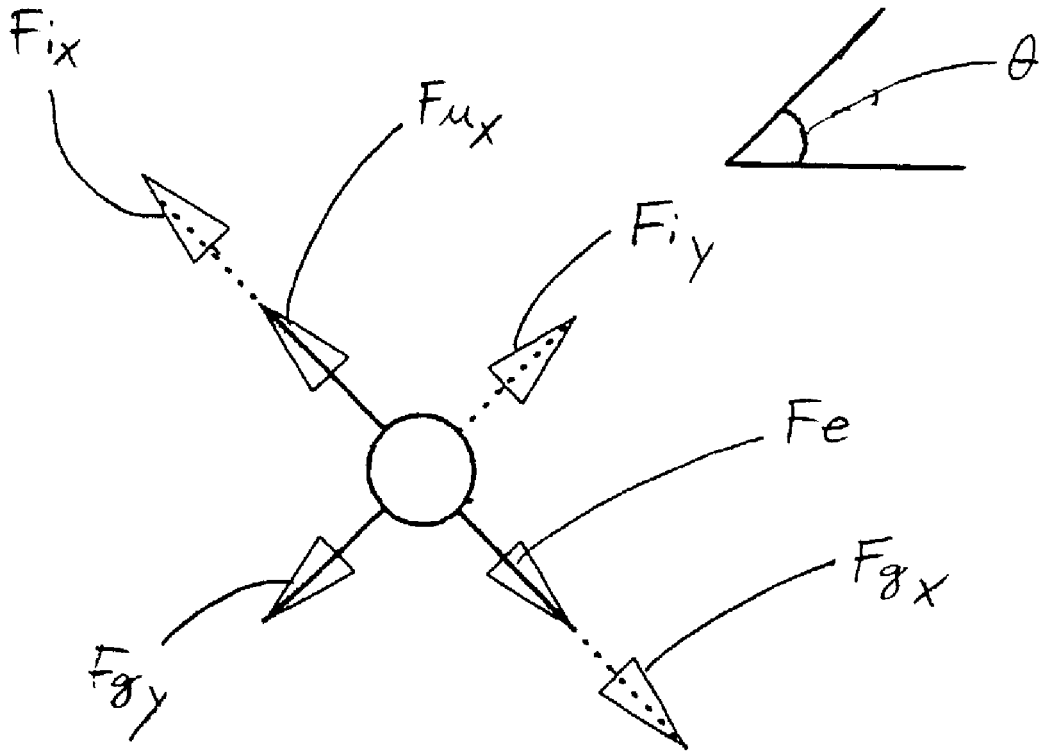
FIG. 4 is a diagram showing the forces acting on a particle in the separator of FIG. 3.

With reference now to FIG. 3, a particle separator 10 or purifier (sometimes also called a separation "cell") is illustrated schematically using the same reference characters appearing in FIG. 2, and a corresponding force diagram is provided in FIG. 4. In the case as in FIG. 3, where the orientation of particle injection or the flow direction F is inclined from a vertical orientation (i.e., $F_g$ has a vector component in both the X- and Y-directions, as compared to only the Y-direction as is the case in FIG. 1), the forces acting on the particle P are:

$$\Sigma F_x = F_e + F_{g(x)} - F_{\mu(x)} - F_{i(x)} = 0 \quad [1.11]$$

$$\Sigma F_y = F_{g(y)} - F_{i(y)} = 0 \quad [1.12]$$

In the X-direction, the forces are:

$$F_e + F_{g(x)} - F_{\mu(x)} - F_{i(x)} = 0 \quad [1.13]$$

Substitution yields:

$$qE + mg\cos(\theta) - 6\pi r\mu V_x - m\frac{dV_x}{dt} = 0 \quad [1.14]$$

In the Y-direction:

$$F_{g(y)} - F_{i(y)} = 0 \quad [1.15]$$

Substitution yields:

$$mg\sin(\theta) - m\frac{dV_y}{dt} = 0 \quad [1.16]$$

Accordingly, when θ (the angle between the direction of the electric field force and gravity) is 90°, as in the vertical orientation described above, Equation 1.14 is identical to Equation 1.8 and Equation 1.16 becomes identical to Equation 1.10. Thus, as stated above, only the electric field force acts to force or deflect the charged particle P in the X-direction and the viscous force and inertial force actually oppose the deflection.

However, when θ is 0°, Equation 1.14 becomes:

$$qE + mg - 6\pi r\mu V_x - m\frac{dV_x}{dt} = 0 \quad [1.17]$$

Therefore, at θ=0° (which occurs when the direction of the electric field force is parallel to the direction of gravity), the forces acting on a particle P due to the electric field and gravity are additive. Indeed, gravity has the maximum effect in this situation, and the influence decreases as the magnitude of the angle θ increases toward the vertical orientation (e.g., θ is an acute angle).

Figure 7D:
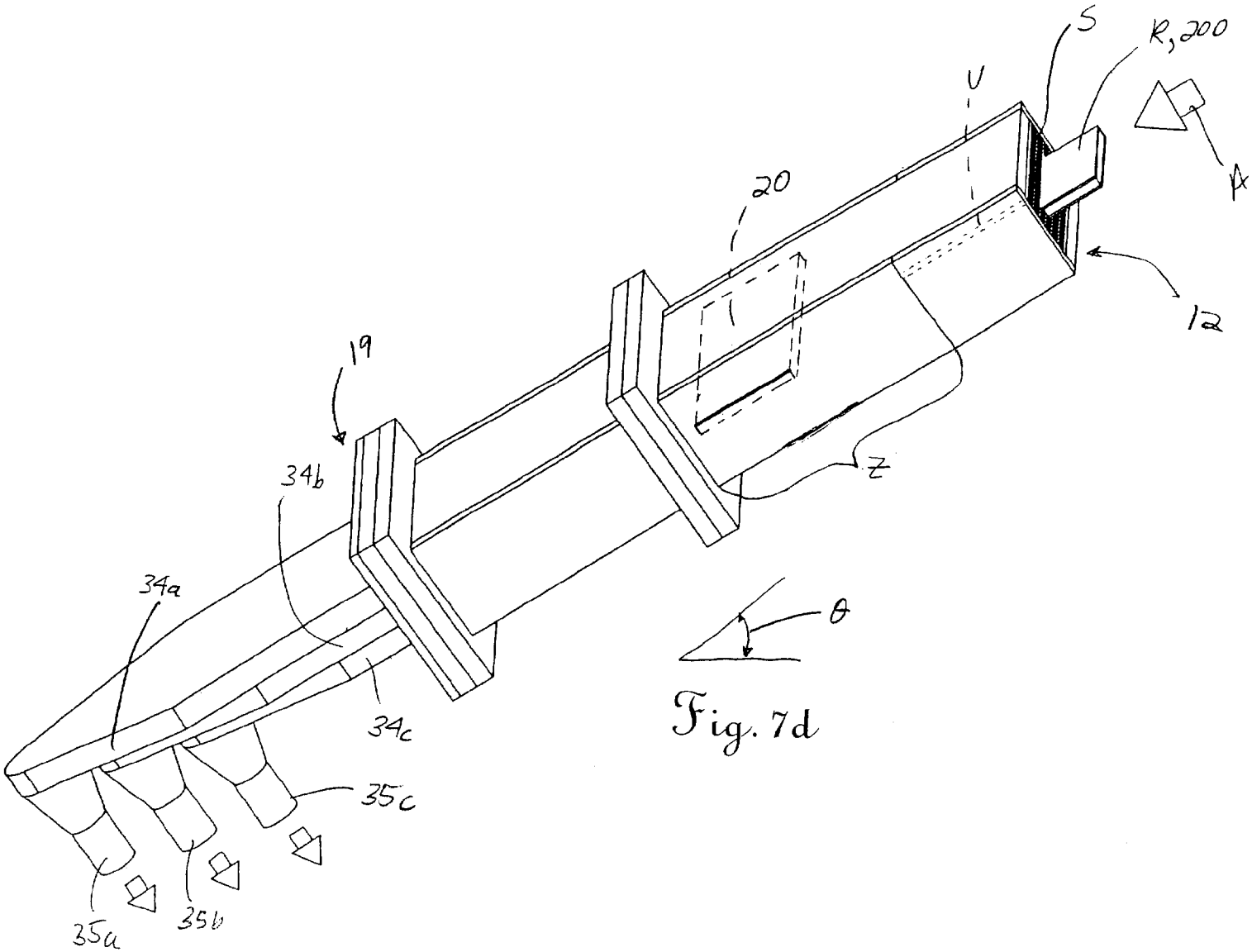

Applying this concept to a non-vertically oriented separator allows for differences in the mass of the charged particles to be advantageously amplified and used to advantage. One example of such a separator 10 in which θ=0° (e.g., the direction of the electric field force is parallel to the direction of gravity), is disclosed in FIG. 5. In the illustrated embodiment, the separator 10 includes a generally tubular (hollow and, for purposes of illustrating one embodiment, rectangular in cross-section), elongated body. The body includes an entrance end or inlet 12 for receiving particles, including a mixture of different particles (preferably a dry mixture of two or more species of fine-sized (<1 μm to 1000 μm diameter, and most preferably less than 200 μm diameter) entrained in or carried by a driving fluid, such as a gas flow (note arrows F indicating direction of flow/particle conveyance). The fluid flow carrying the mixed particles may be supplied by or through a diffuser or sprayer (see FIG. 7*d*) positioned in or adjacent to the inlet 12 of the separator 10. Where appropriate or desired, the upstream end or inlet 12 of the separator 10 may also be provided with flow smoothing structures or straighteners (such as elongated tubes, vanes or the like; see inlet ends of elongated straightener tubes S in FIG. 7*d* and note phantom depiction of a single tube U) for ensuring that any co-flow of gas introduced does not disrupt the particle mixture flow introduced by the diffuser R (that is, the co-flow is straight and smooth and in this regard facilitates smooth flow of the particle mixture). The co-flow of gas is also designed to minimize or eliminate particle attachment to or bombardment with the electrodes 14, 16 that create the electric field. Preferably, the co-flow is devoid of particles.

In the preferred embodiment, an electric field is created by a pair of spaced, elongated, plate like electrodes 14, 16 positioned at a selected location within a portion of the body of the separator 10. The electric field may be of a preselected magnitude and generally defines at least one electric field zone Z. Preferably, the electrodes 14, 16 are positioned just downstream of the inlet 12 (which may include the outlet of any diffuser and flow straighteners positioned therein). The electrodes 14, 16 may be provided with different polarities as desired for deflecting (which may comprise attraction or repulsion, depending on the relative charges) and otherwise influencing the trajectory of the path of travel of the species of particles having a selected charge (i.e., selectively charged particles) within the separator 10 for later collection. Each electrode 14, 16 thus may be connected to a voltage source (not shown), which may be variable to facilitate selective control of the magnitude of the electric field in the corresponding zone Z.

Regarding collection, a portion of the separator 10 may include at least one, and preferably a plurality of solid, unapertured/unperforated walls or partitions 18 defining at least two channels 21 for receiving at least a portion of, and preferably a substantial amount of, the particles having the selected charge after entering the electric field zone Z. The ultimate number collected depends on the relative position of the particles within the tubular body (which depends on the path of travel, as influenced by the particle charge, the velocity of the particles, the orientation (angle θ), the position or location of the partitions 18, and the polarity of the electrodes 14, 16 and the magnitude of the electric field, and whether any co-flow is present). The leading edge of each partition 18 is preferably just downstream from the electric field zone Z. At the exit end or outlet 19 of the separator 10 adjacent to the trailing edge of each partition 18, the channels 21 may be in communication with corresponding downstream collectors (not shown), such as bins or hoppers, for receiving a substantial amount of at least one separated species of particles (which is preferably substantially pure).

To maximize the additive effects of the electric field and gravitational forces, the polarity of the spaced electrodes 14, 16 may be chosen to force particles having a large mass (due to either size or density) in the direction of gravity (i.e., downward in FIG. 5) and to force smaller mass particles (which are influenced by gravity to a lesser extent) in the opposite direction. More specifically, when the separator 10 is oriented horizontally (that is, with a longitudinal axis parallel to a horizontal plane and the direction of the electric field force aligned with or parallel to the direction of gravity) such that θ is 0° (see FIG. 5), if such small mass particles are impurities and attain or are charged to a polarity opposite that of the large mass particles, then the impurities can be forced or deflected in the direction opposite the direction of gravity (i.e., upwards rather than downward) by providing the upper electrode 14 with the opposite polarity. Accordingly, in this mode of operation, the smaller mass impurity particles are effectively levitated by the electric field force created by the upper electrode 14, whereas larger mass particles are forced downwardly by the combined forces created by the lower electrode 16 and gravity.

Although the gravitational force on smaller mass and fine-sized particles is relatively small, gravity can significantly influence the purification of physical mixtures of particles, especially when differences in density (ρ) and particle size (r) exist. For example, metal powders typically have densities between 6–8 g/cm$^3$, whereas inorganic or organic impurities that may be physically mixed with the metal powder typically have particle densities ranging from between 2–5 g/cm$^3$. Inorganic oxides, like combustion ash, typically have a wide range of densities (e.g., between 0.5–4 g/cm$^3$) and may also have a wide distribution of particle sizes). These differences in size and density can be magnified and taken advantage of using the above-described separator 10 oriented at an angle θ such that the direction of the electric field force $F_e$ is not perpendicular to the direction of gravity. In other words, gravity is actually used to improve the separation efficiency and effectiveness.

In the typical prior art separator shown in FIG. 1, a mixture of particles injected into the electric field E have a velocity only in the Y-direction (i.e., $V_x$=0). However, the particle mobility in the X-direction (that is, in the direction of the electric field force $F_e$) must also be considered, since only through such motion is separation/purification achieved. By solving the equations relating to the motion of particles under two phase flow conditions, particle mobility has been described in terms of relaxation time, $t_r$, which is the time needed to accelerate the particles from zero velocity to 68% of their final velocity. The relaxation time, $t_r$, may be expressed as:

$$t_r = \frac{2\rho r^2}{9\mu} \qquad [1.17]$$

In other words, the relaxation time, $t_r$, is directly proportional to the density multiplied by the square of the particle radius (i.e., greater particle densities and/or greater particle radii decrease the propensity for particle acceleration in the X-direction (which may be parallel to the electric field when $\theta=0°$)).

To demonstrate this, consider a metal powder with a density $\rho_m=8$ g/cm$^3$ with inorganic impurity particles with a density $\rho_i=4$ g/cm$^3$. With the metal powder and impurity particles having equal radii (i.e., $r_i=r_m$), the ratio of the relaxation time for the metal powder relative to the impurity particles ($t_{rm}:t_{ri}$) is 2:1. In other words, the impurity particles would accelerate twice as fast as the metal particles. However, when the radius of the impurity particles is twice that of the metal particles (i.e., $r_i=2r_m$), the ratio of relaxation time for the metal powder relative to the impurity particles ($t_{rm}:t_{ri}$) is 1:2. In other words, the metal particles would accelerate twice as fast as the impurity particles. In the case where a mixture of inorganic oxide particles in which the density is uniform but one species of particles has twice the radius of the other (i.e., $r_1=2r_2$), the ratio of the relaxation time of one species relative to the other ($t_1:t_2$) is 4:1, which means that the small particles accelerate four times faster than the large particles.

As another example, a 60 μm silica particle ($\rho=2.3$ g/cm$^3$) has a relaxation time, $t_r$, of 20 ms, while a 40 μm silica particle has a relaxation time of 10 ms. In the separator 10 described above, the velocity component in the Y-direction, $V_y$ (which is non-vertical) is typically between 1–25 m/s while the longitudinal dimension $H_1$ of the electrodes 14, 16 is typically between 10–80 cm. Taking $V_y=5$ m/s and $H_1=25$ cm, the time a particle is within the electric field is $t=V_y/H_1=0.05$ seconds, or 50 ms. Accordingly, the relaxation time $t_r$ for both particles is close in value to the time t, that they reside within the electric field zone Z.

To take advantage of the similarities between the residence and relaxation times, t and $t_r$, and hence effect separation at least in part on the basis of differences in particle mass, density or size, it is possible to vary: (1) the velocity in the Y-direction, $V_y$, which changes the residence time of the particles within the electric field zone; or (2) the longitudinal dimension $H_1$ of the electric field zone Z, which also changes the particle residence time. Varying the velocity $V_y$ is readily accomplished by either increasing or decreasing the gas flow velocity through the separator 10 and, more particularly, the diffuser R. However, depending on the characteristics of the physical mixture to be purified, it may not be possible to further or selectively purify on the basis or particle size or density by changing the velocity $V_y$. If this is the case, then changing the longitudinal dimension $H_1$ is possible. However, changing the external dimensions of the separator 10, such as by removing or replacing the electrodes 14, 16, is not easy once it is constructed.

Figure 5:
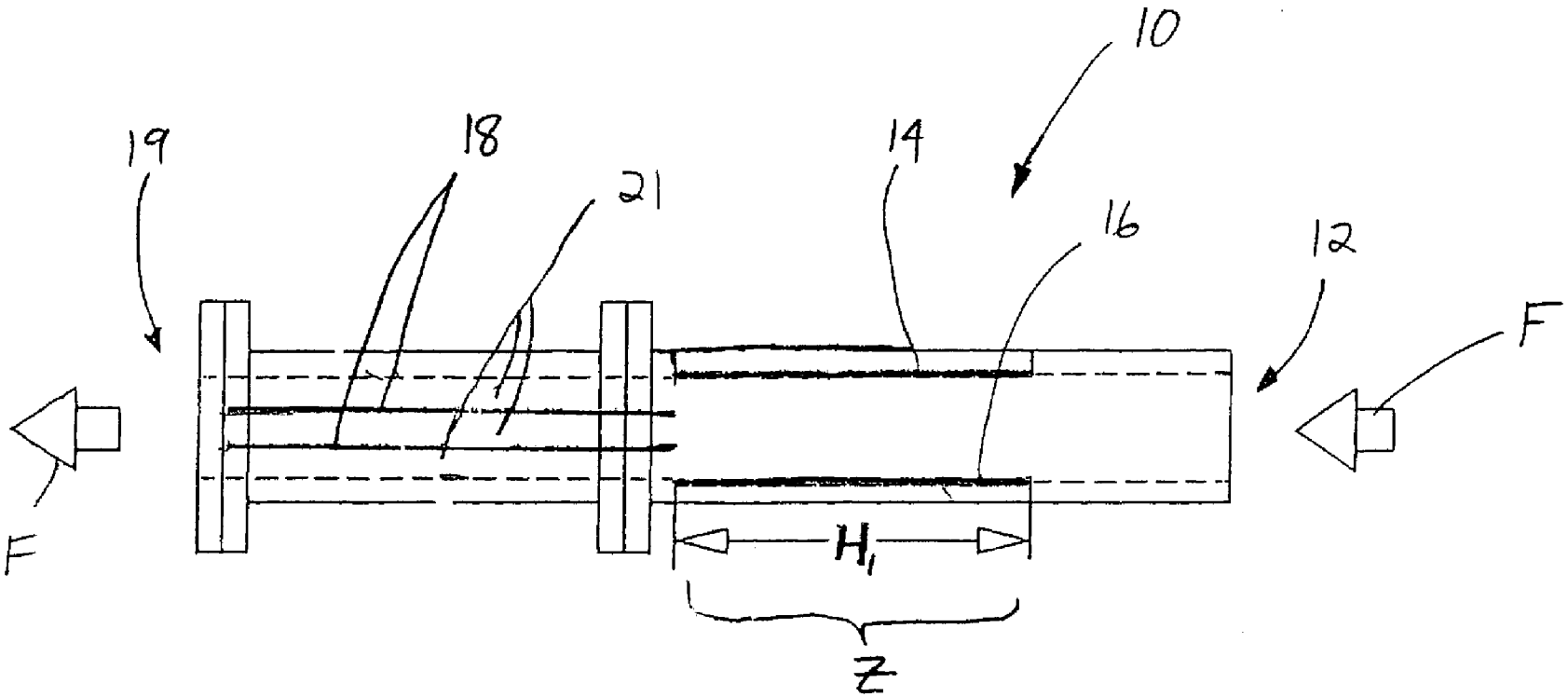
FIG. 5 is a side schematic view of one possible embodiment of a separator oriented such that a direction of the electric field force is not perpendicular to a direction of gravity.
Figure 6A:
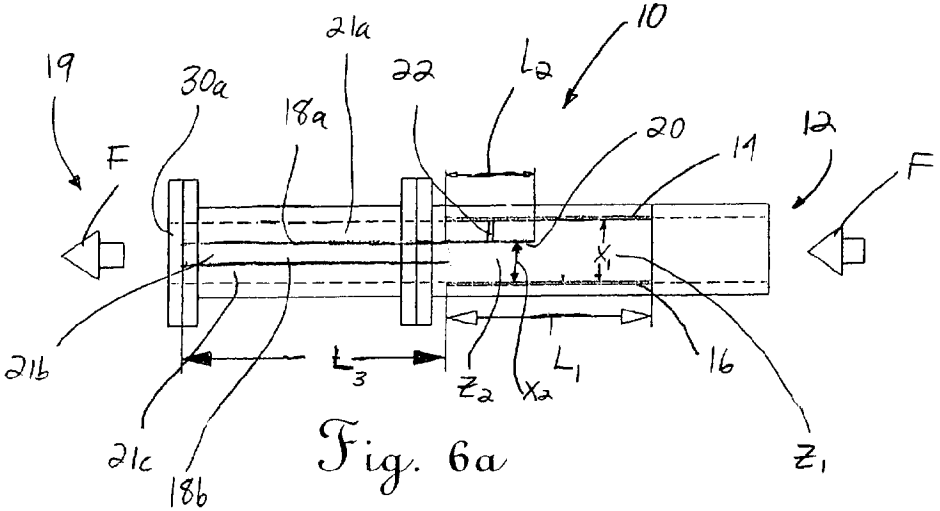
FIGS. 6*a*–6*d* are side, top, end, and perspective views of a second possible embodiment of a separator including first and second spaced electrodes and a third extension electrode.
Figure 6B:
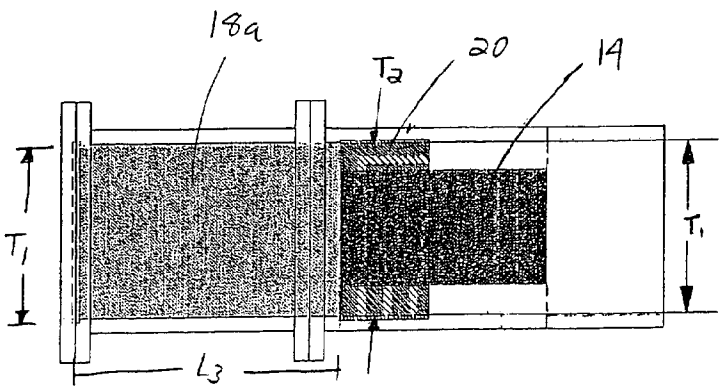
Figure 6C:
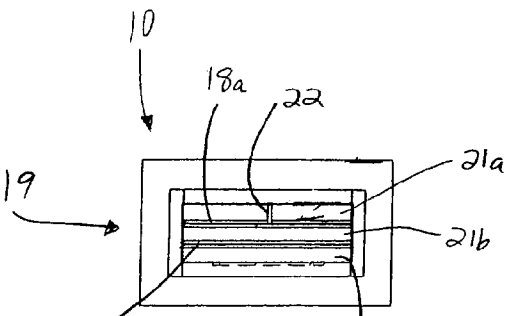
Figure 6D:
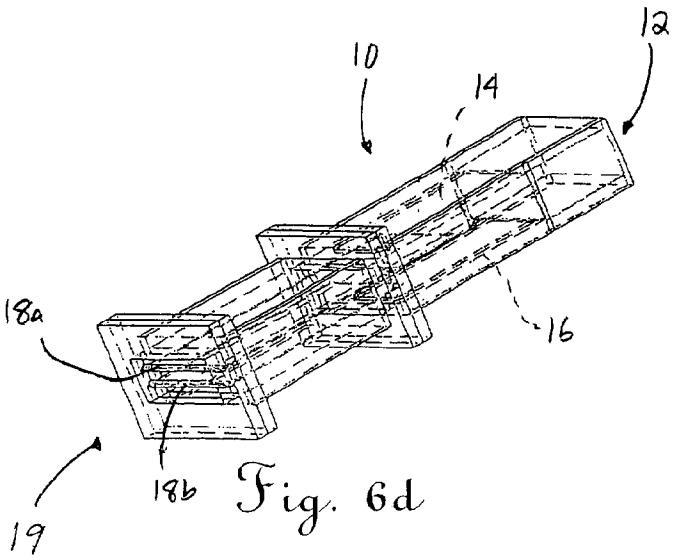

To overcome this problem, and in accordance with a second aspect of the invention, a third or "extension" electrode 20 may be incorporated between the existing electrodes 14, 16 even after the separator 10 is constructed. A schematic representation of this electrode 20 and its preferred placement in the separator 10 of FIG. 5 is shown in FIGS. 6*a*–6*d*. Referring first to FIGS. 6*a* and 6*b*, the extension electrode 20 aligned with the Y-direction (i.e., along the length when $\theta=0°$, or the height when $\theta=90°$) is placed in and supported by the portion of the separator 10 including the spaced electrodes 14, 16 that define a first electric field zone $Z_1$ (but could also be supported by one of the other electrodes, such as by using a rigid connector or post). A separate voltage source may be provided, or a connector 22 may electrically couple or connect the extension electrode 20 to an adjacent electrode, such as the first or upper electrode 14, such that the two have identical polarities. Although FIGS. 6*a*–6*d* show the extension electrode 20 in the "upper" portion of the separator 10 when horizontally oriented (e.g., $\theta=0°$, which occurs when the direction of the electric field force is parallel to the direction of gravity), it can be positioned at any point along the Y-direction within the separator 10, and may have either a negative or positive polarity.

In the embodiment of FIG. 6*a*, a transverse dimension $X_1$ (i.e., the height when aligned with or parallel to the direction of gravity) of the internal passage defined in the body of the separator 10 in the portion including first electric field zone $Z_1$ is established by the electrodes 14, 16, and is greatest near the entrance or inlet 12 where the particles may be introduced via a diffuser R (not shown). The extension electrode 20 positioned as shown in this figure forms a second electric field zone $Z_2$ having a transverse dimension of $X_2$, which is less than dimension $X_1$. Preferably, a second, transverse dimension $T_2$ (i.e., the width) of the extension electrode 20 is generally equal to or greater than the corresponding dimension $T_1$ of the passageway formed in the body of the separator 10 for receiving the particle mixture flow. In FIG. 6*a*, the longitudinal or length dimension $L_1$ ($\theta=0°$) of the primary electrode 14 or 16 to which the extension electrode 20 is connected may be equal to the corresponding dimension $L_2$ of the extension electrode 20, but preferably $L_2<L_1$.

As briefly mentioned above, a portion of the separator 10 downstream from the electric field zones $Z_1$, $Z_2$ and preferably near the outlet 19 includes one or more baffles, dividers or partitions 18 divide the flow of gas carrying the particles into plural flows or streams. In the embodiment of FIGS. 6*a*–6*d*, two partitions 18*a*, 18*b* are included to create three portions or streams of flow, one of which may include a substantial amount of the particles having the selected charge. Each partition 18*a*, 18*b* preferably extends fully across the interior passageway of the separator 10 in a transverse direction $T_1$ and may have a longitudinal dimension $L_3$ such that it extends from adjacent the leading edge ofthe electrodes 14, 16 (or the extension electrode 20 if $L_1=L_2$) opposite the inlet 12 to adjacent the outlet 19.

In the most preferred embodiment, the extension electrode 20 is located adjacent one of these partitions 18, such as partition 18*a* in FIG. 6*a*, such that the two structures are adjacent to one another and essentially coextensive. As a result of this arrangement, the extension electrode 20 defines a "cut-off" location within the first electric field zone $Z_1$ and establishes a channel 21*a* preceding and inline with the partition 18*a* that defines one product outlet 30*a*. Only particles in the flow that enter this channel 21*a* (which may include particles deflected (attracted) by the upper electrode 14 in the illustrated embodiment) reach the corresponding outlet 30*a*. However, the particles in the remaining fluid flow may still be influenced or deflected by the second electric field zone $Z_2$ created by the extension electrode 20 and the second or lower electrode 16 and, depending on the relative charges, may thus be deflected (attracted or repelled) into one of the remaining channels 21*b*, 21*c* for later collection.

As illustrated in FIGS. 7*a*–7*d*, a manifold 32 may be provided adjacent to the outlet 19 of the separator 10 (and may either comprise a unitary part or portion of it or a separate, but integrally attached component). The manifold 32 includes a passageway 34*a* . . . 34*n* (which in the illustrated embodiment are passageways 34*a*, 34*b*, 34*c*) associated with each outlet 30*a* . . . 30*n* (which in the illustrated embodiment are outlets 30*a*, 30*b*, and 30*c*). In this embodiment, the outlets 30*a*, 30*b*, 30*c* each have a generally rectangular cross-section, and the corresponding passageways 34*a*, 34*b*, 34*c* transform or taper from a matching cross section at the entrance or inlet end to a generally circular cross section at the exit or outlet end (which as shown as being in the form of a depending portion 35*a*, 35*b*, 35*c* in FIG. 7*a*, but could also be inline) for connection to conventional cylindrical pipes or tubes for delivering the particles or product received or collected in each channel 21*a*, 21*b*, 21*c* to an appropriate holding or storage location, such as a bin, hopper, or like structure (see FIG. 8). Preferably, the longitudinal dimension $L_3$ of the partitions 18*a*, 18*b* is sufficient to eliminate the effects of non-uniform flow or turbulence that may be created within the manifold 32 as the rectangular cross-section at the inlet is reconfigured to the circular cross-section at the outlet.

Figure 8:
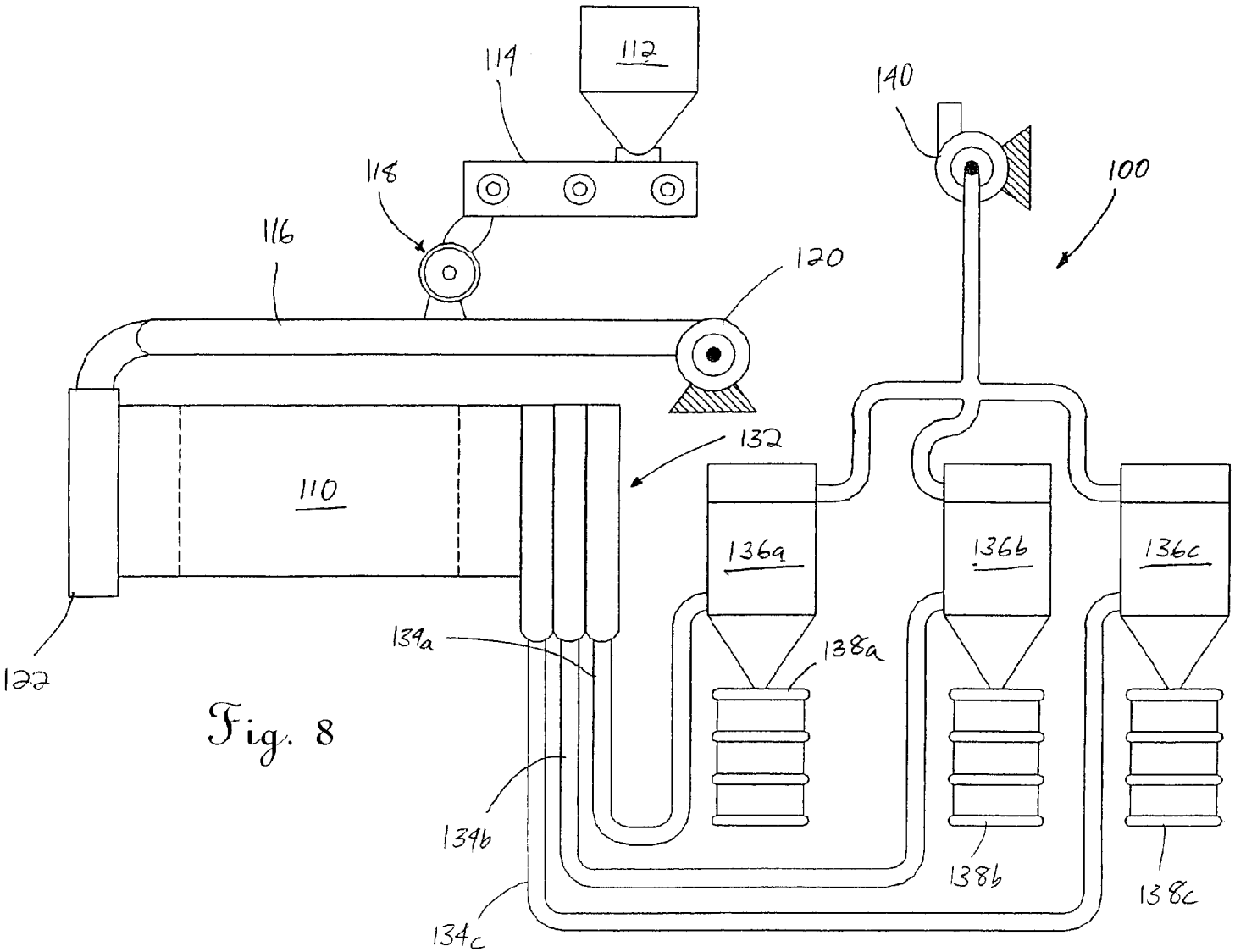
FIG. 8 is a schematic view of an overall separation system including a separator forming one aspect of the invention.

FIG. 8 illustrates schematically an overall layout of a particle separation/purification system 100 including the separator 110 forming one aspect of the present invention. With the exception of the use of a separator 110 oriented at an "acute" angle θ (less than 90°) relative to a vertical plane such that a direction of the electric field force is not perpendicular to the direction of gravity, the overall system 100 described herein is similar in many respect to the one disclosed in commonly assigned U.S. Pat. No. 6,498,313 to Stencel et al., the disclosure of which is incorporated herein by reference.

Beginning at the top of FIG. 8, the system 100 may include a holding tank 112 for delivering a material, such as a particle mixture, to a feeder 114. The feeder 114 may be selected to supply the material at a pre-determined or desired flow rate, which may vary depending on the type of material and other characteristics of the system 100. The feeder 114 in turn delivers the material to a feeder line 116 via a device 118 capable of preventing the backflow of fine particulate matter, such as a star valve, airlock, or the like. The feeder line 116 is in fluid communication with a forced draft fan 120, which provides the fluid medium in which the material or particles are entrained, carried, and driven through the system 100 (i.e., the driving fluid). The medium is preferably a relatively dry gas, such as air, but other gases such as nitrogen, helium, argon, carbon dioxide or combustion flue gas can be used at ambient temperatures or temperatures as high as 300° C.

The feeder line 116 is preferably constructed of wear-resistant materials, such as steel, specialty alloys, ceramics, ceramic-lined metals or polymers, or polymers (e.g., polyurethane), and should be sized to handle solid flow rates as required based on the capacity of the overall system 100. The velocity of the particle/gas mixture within the feeder line 116 may be 1–50 m/s, but is preferably around 10 m/s. The flow in the feeder line 116 is preferably turbulent to promote particle charging, with a Reynolds number, $R_e$, greater than 2300 (where $R_e$=DV/μ and D=particle diameter, V=fluid flow velocity, and μ=the kinetic viscosity of the fluid).

A diffuser 122 is provided adjacent to the inlet of the separator 110 for receiving the flow from the feeder line 116. The diffuser 122 may be of any known type of device for creating a spray of a fluid medium carrying particles having a generally uniform flow pattern (see FIG. 10*a*). An exemplary diffuser that can be used with both the separator 110 and forming another aspect of the invention disclosed herein is outlined in the description that follows.

The collected particles exit the separator 110 via manifold 132, which as described above may include multiple passageways each having an outlet (three in FIG. 8, but more or fewer may be provided depending on the number of channels provided in the separator 110). The material exiting each outlet is then fed through a corresponding delivery line 134*a*, 134*b*, 134*c* to a particle-gas disengagement device, such as a cyclone 136*a*, 136*b*, 136*c*, bag filter, or the like, for collection in a corresponding drum or bin 138*a*, 138*b*, 138*c*. Each of the cyclones 136*a*, 136*b*, 136*c* is in fluid communication with an induced draft fan 140 that, together with the forced draft fan 120, creates the pressure balance within the system 100 necessary for optimum performance. Preferably, the pressure is maintained systemwide at a level slightly less than atmospheric pressure by an amount of approximately 1–50 inches of water or 2.54–127 cm Hg.

Figure 8A:
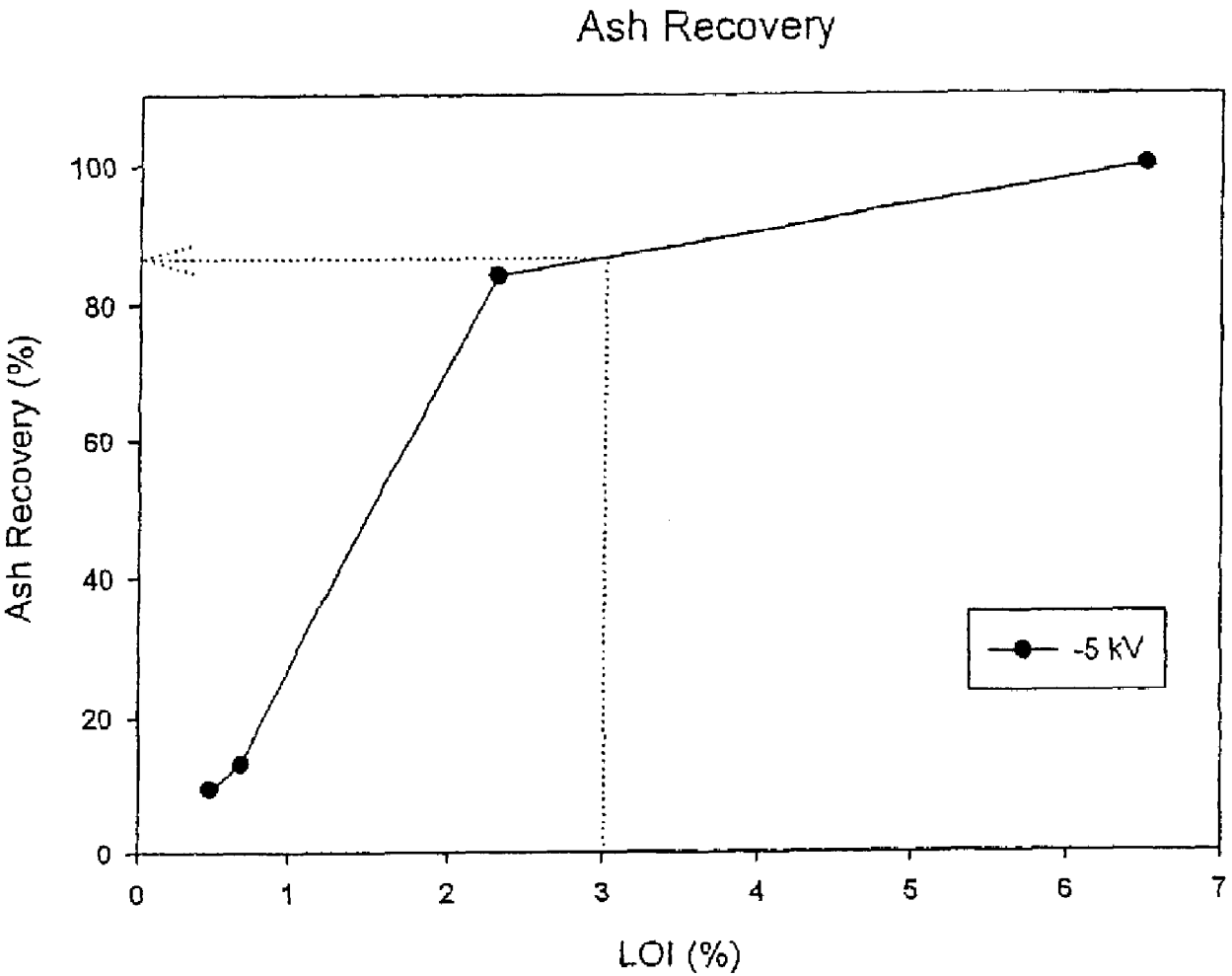
FIG. 8*a* is a graphical representation of experimental data obtained using the separator forming one aspect of the present invention.
Figure 9A:
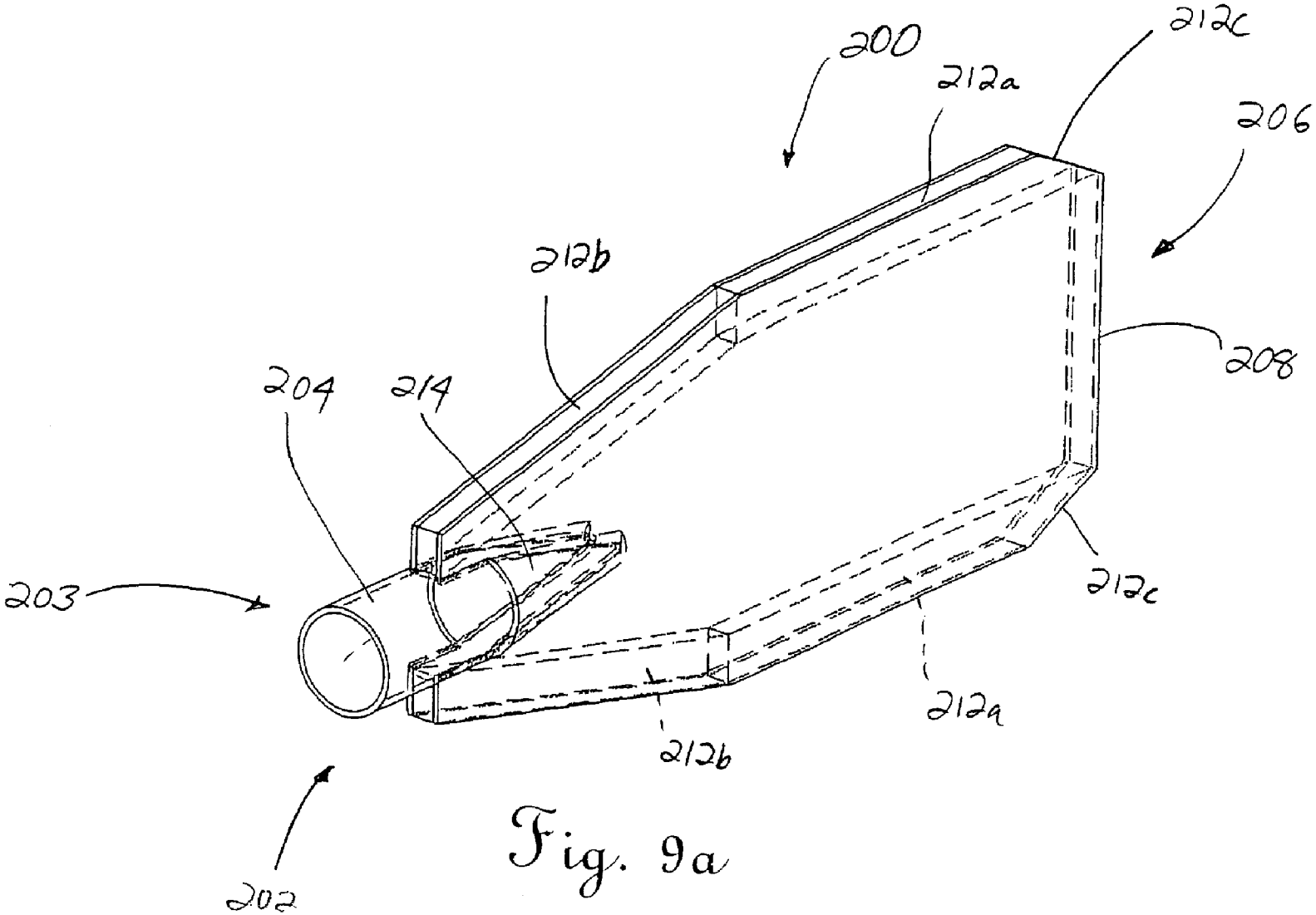
FIGS. 9*a*–9*d* are perspective, top, side, and end views of a diffuser or diffuser assembly forming one aspect of the invention.
Figure 9D:
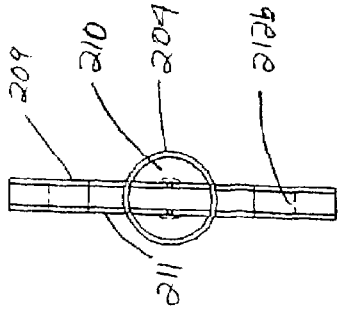
Figure 9B:
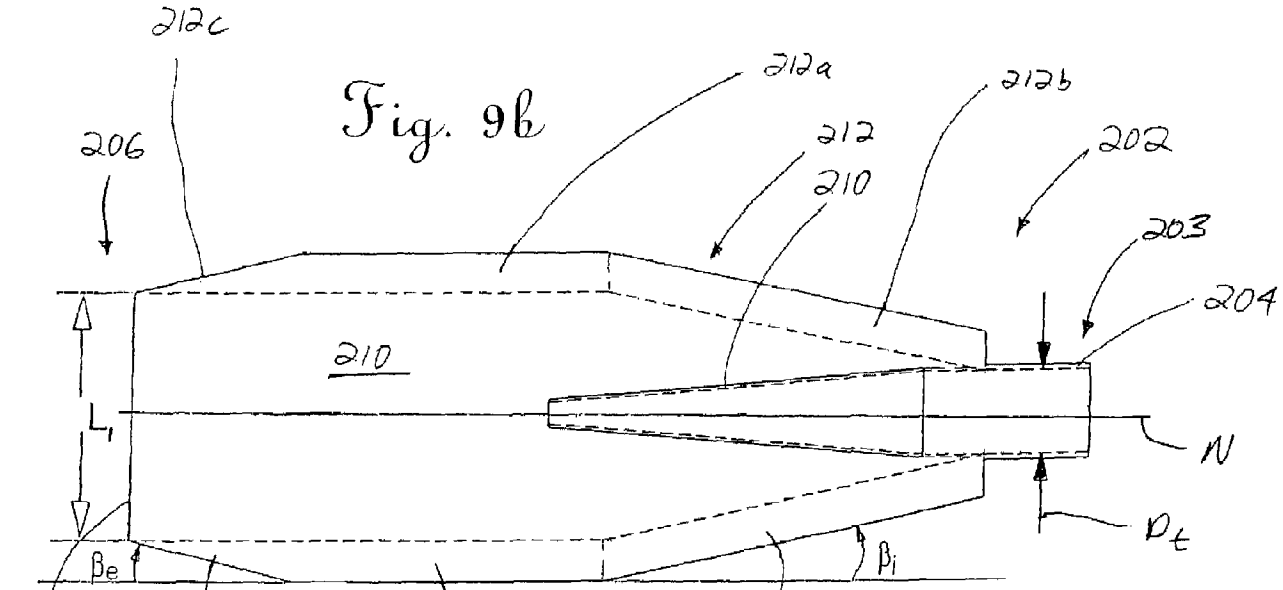
Figure 9C:
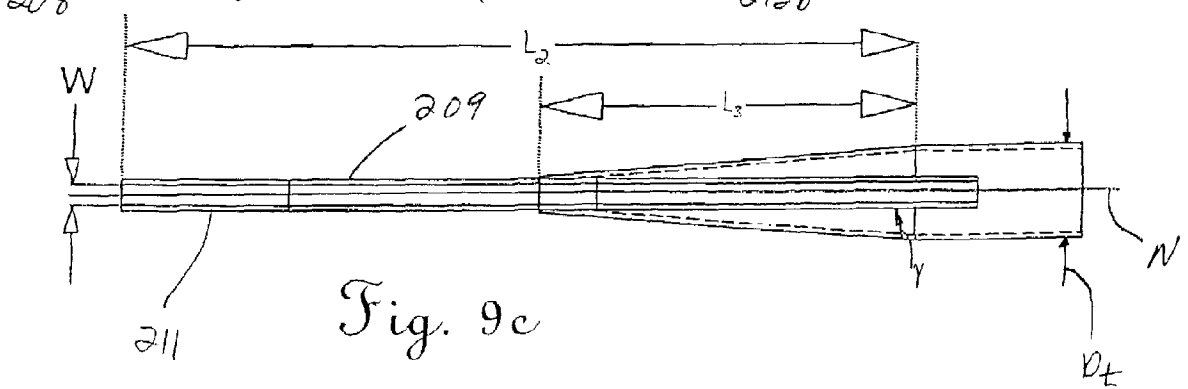

Experiments were conducted using the above-described separation system 100 to extract selectively charged low density particles and to purify coal combustion fly ash (i.e., the removal of carbon from the ash) using an electric field having a voltage of −5 kV. The data is presented in the following table and illustrated graphically in FIG. 8*a*:

| Sample | Weight (%) | Density (g/cm$^3$) | LOI (%) |
|---|---|---|---|
| #1 I | 1.9 | 2.2 | 1.0 |
| #1 J | 78.0 | 2.1 | 0.8 |
| #1 K | 20.1 | 2.0 | 0.8 |
| #2 I | 73.0 | 1.9 | 0.4 |
| #2 J | 24.1 | 2.2 | 1.2 |
| #2 K | 2.9 | 2.4 | 2.4 |
| #3 I | 68.1 | 1.9 | 0.3 |
| #3 J | 29.0 | 2.2 | 1.1 |
| #3 K | 2.9 | 2.4 | 2.4 |
| #4 I | 53.8 | 1.9 | 0.3 |
| #4 J | 43.6 | 2.1 | 1.0 |
| #4 K | 2.6 | 2.4 | 2.2 |

This data includes the yields (weight percent), densities (g/cm$^3$) and LOIs (loss-on-ignition percentages) of three products from processing a sample having initial density of 2 g/cm$^3$ and an LOI of 0.6%. Product I is extracted from the first channel 21*a* associated with the extension electrode 20; product J is extracted from the second (middle) channel 21*b* in the separator 10; and product K is extracted from the third (lower) channel 21*c*.

The data illustrates that the separator 10 achieved: (a) greater than 70% yield of a product having a density of 1.9 g/cm$^3$ and a LOI of 0.3%; (b) approximately 3% yield of a product having a density near 2.4 g/cm$^3$ and a LOI of 2.4%; (c) between 24–78% yield of J products depending on the operational parameters; and (d) the J products contained densities and LOI's between those of the products I and K. The data further demonstrates that, for an ash with an LOI of 6.5%, nearly 90% of the desired product was recovered at a 3% LOI at a voltage of −5 kV. Such a yield was previously unattainable using voltages less than 20 kV and a separator in which the sole direction of the electric field force vector is perpendicular (i.e., horizontal) to the direction of gravity (i.e., vertical). This establishes that, with the enhancing effects of gravity, a comparable result or product is obtained using an electric field at a significantly lower voltage.

In accordance with another aspect of the invention disclosed herein, a novel diffuser or diffuser assembly for creating a spray of gas and/or particles is disclosed. One embodiment of the diffuser or diffuser assembly 200 is shown in FIGS. 9*a*–9*d*. The diffuser 200 includes an entrance or inlet end 202 associated with a nozzle 203. The nozzle 203 includes a relatively short, generally circular or tubular portion 204 defining an inlet opening for receiving a fluid medium, including possibly one carrying wet or dry particles or the like. The tubular portion 204 is preferably of generally constant diameter $D_t$. An outlet or outlet end 206 of the diffuser 200 opposite the inlet end 202 includes a generally elongated, ribbon-like or rectangular opening 208 through which the spray emanates having an elongated profile. As should be appreciated, the opening 208 therefore includes both a longitudinal dimension or length, $L_1$, and a transverse dimension or width, W.

The body 210 of the diffuser 200 also has a longitudinal dimension or length, $L_2$, as measured from adjacent the inlet end 202 (and, more particularly, the junction between the tubular portion 204 of the nozzle 203 and a frusto-conical portion 214, see below) to the outlet end 206. This body 210 is generally symmetrical about a longitudinal centerline N and includes a top wall 209, a bottom wall 211, and opposed sidewalls 212 adjacent to and interfacing with the elongated sides of the top and bottom walls 209, 211.

In the illustrated embodiment, each sidewall 212 includes three portions or sections, each of which has an inner surface (noted dashed or phantom lines). A first portion 212*a* of each sidewall is generally aligned with or parallel to the longitudinal centerline N of the body 210 and, together with the top and bottom walls 209, 211, defines an internal passageway having a generally rectangular cross-section having a generally constant area.

A second portion 212*b* of each sidewall 212 generally closer to the inlet end 202 is sloped at least along the inner surface thereof and thus defines an included angle $\beta_i$ with a line drawn parallel to the first portion 212*a* or the centerline N of the body 210 (shown adjacent to the outer surface of the sidewall 212 for clarity). Accordingly, in this embodiment, the generally rectangular cross-section of the internal passageway is maintained throughout. The third portion 212*c* of each sidewall 212 is also tapered, but along an outer surface and toward the exit or outlet end 206 adjacent the opening 208. A line drawn parallel to this surface and in the same plane as the centerline N thus forms an included angle $\beta_e$(which is preferably acute and on the order of about 15°, but could be up to 45°) with a line drawn parallel to the first portion 212*a* or the centerline N. However, the inside surface is generally coextensive with the inside surface of the first portion 212*a*, which as described above in conjunction with the top and bottom walls 209, 211 creates a passageway having a generally rectangular cross-section.

The nozzle 203 also includes a frusto-conical portion 214 defining a transition into the body 210 of the diffuser 200 upstream from the outlet end 206. The frusto-conical portion 214 may define an angle $\gamma$ with a generally horizontal axis, such as may be defined by one of the top or bottom walls 209, 211 of the body 210 or the centerline N thereof when oriented parallel with a horizontal plane (e.g., perpendicular to the direction of gravity). This angle $\gamma$ determines a longitudinal dimension or length, $L_3$, of the frusto-conical portion 214 of the nozzle 203, and may be selected using the criteria outlined in the following description depending on the desired flow pattern.

Figure 10A:
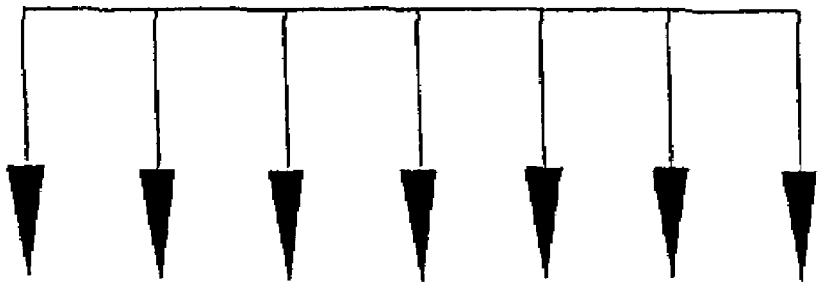
FIGS. 10*a*–10*c* illustrate exemplary spray profiles that may be achieved using different embodiments of the diffuser.
Figure 10B:
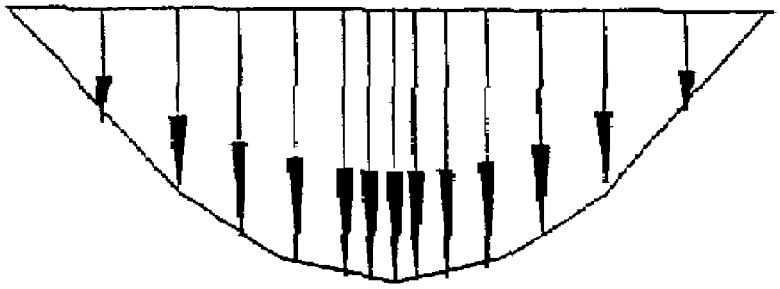
Figure 10C:
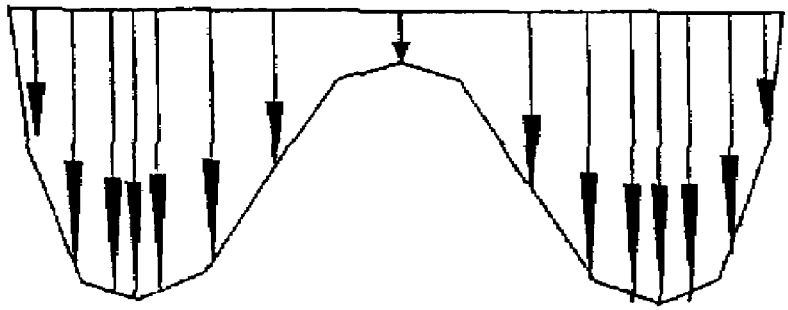

Top views of different patterns of flow or spray exiting the opening 208 of the diffuser 200 are shown in FIGS. 10*a*, 10*b*, and 10*c*. The following criteria may be used to achieve the flow pattern shown in FIG. 10*a* using the diffuser 200 described above:

(1) The value of $\beta_i$ is preferably less than or equal to about 7°, which provides at least the inside surface of the second portion 212*b* of each sidewall 212 with a slight taper relative to a vertical plane when the top and bottom walls 209, 211 are oriented parallel to a horizontal plane. This helps to eliminate phase separation at the inside, outer edge of the diffuser 200 during the expansion of any fluid medium introduced through the circular nozzle 203 to the rectangular cross section of the internal passageway in the body 210. However, values of $\beta_i$ as great as 15° have been used experimentally with minimal disruption or change of the outlet flow from that presented in FIG. 10*a*.

(2) The value of the angle $\gamma$ is such that no or minimal additional pressure drop results from a change in cross-sectional area of the passageway defined by the sidewalls 212 when the transition is made from the circular cross-section of the nozzle 203 to the rectangular cross-section of the internal passageway of the body 210. In other words, as the diameter of the frusto-conical portion 214 decreases, the sidewalls 212 outwardly diverge and the longitudinal dimension, $L_1$, between them increases such that, from the end of the frusto-conical portion 214 of the nozzle 203 adjacent the inlet end 202 to the outlet end 206 of the diffuser 200 (distance=$L_2$), the total internal cross sectional area is constant and generally equal to the internal cross sectional area of the nozzle 203 (i.e., $\pi D^2/4$) through which the fluid medium (gas) and/or particles are delivered plus the internal cross-sectional area of the rectangular passageway at that same location.

(3) The transverse dimension or width, W (that is, the distance between the spaced top and bottom walls 209, 211), is maintained constant to within approximately +/−2% along the entire body 210 of the diffuser.

(4) The magnitude of the dimension $L_2$–$L_3$ (that is, the distance from the outlet end of the frusto-conical portion 214 of the nozzle 203 to the outlet end 206 of the diffuser 200 where the opening 208 is provided) is established such that $(L_2-L_3)/W>20$.

Figure 11A:
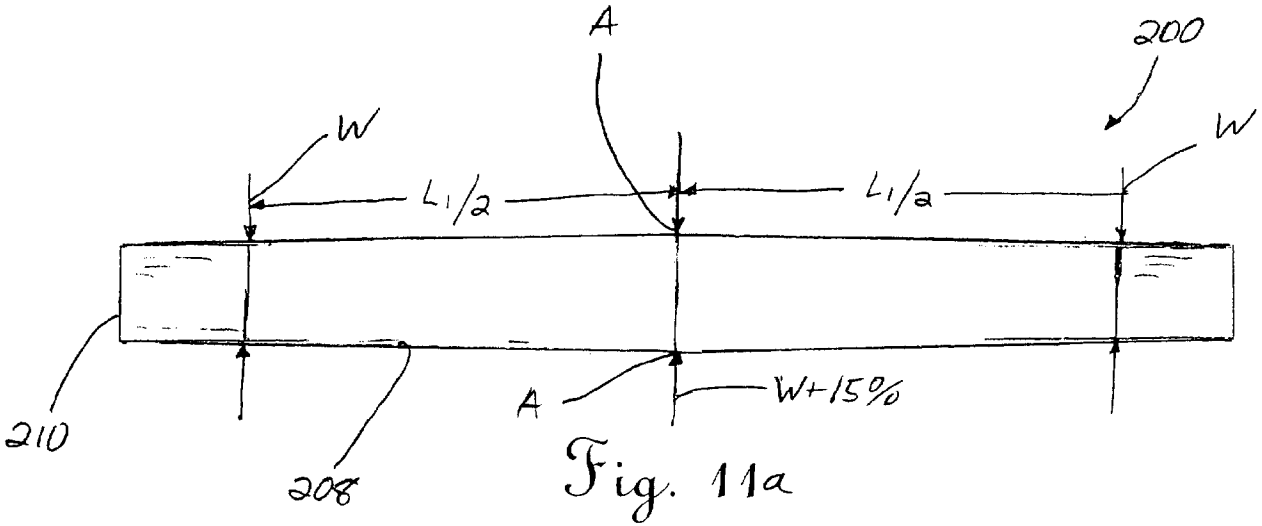
FIGS. 11*a* and 11*b* are enlarged end views of the different embodiments of the diffuser for achieving the spray profiles shown in FIGS. 10*b* and 10*c*, respectively.

To establish a flow pattern like the one shown in FIG. 10*b* using the diffuser 200:

(1) the value of the angle $\beta_i$ is to be increased such that $\beta_i>15°$; and/or (2) the transverse dimension or width W of the body 210 can be made non-uniform such that at the midpoint or center ($L_1/2$) between the sidewalls 212, the width is W+15% or greater. This provides the top and bottom walls 209, 211 with a slightly V-shaped appearance when viewed in cross-section or from the outlet end (see FIG. 11*a*, which is enlarged, not drawn to scale, and omits the nozzle 203). The increase in width W can be established in a gradual manner from one side of the diffuser 200 to the other such that the apex A is at the midpoint or center ($L_1/2$), as shown in FIG. 11*a*, or the increase can be more abrupt, starting at a point closer to the center (not shown). In either case, the top and bottom walls 209, 211 are considered to be tapered or sloped, but the cross-section and opening are still considered generally rectangular (even though the body technically has six different sides).

Figure 11B:
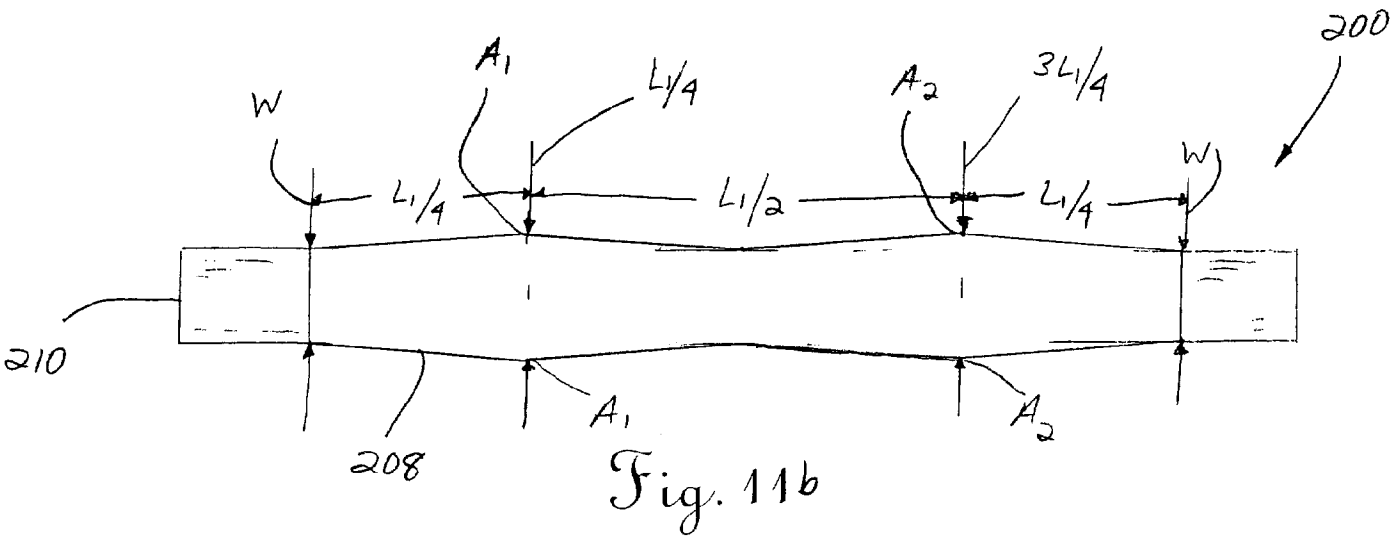

To achieve a flow pattern like that shown in FIG. 10*c*, the following changes may be made:

(1) the width W of the body 210 is made non-uniform such it is greater (e.g., W+15%) at two locations, $\frac{1}{4}L_1$ and $\frac{3}{4}L_1$ (see FIG. 11*b*, which again is not to scale and omits the nozzle 203), thus providing the top and bottom walls 209, 210 with a W-shaped appearance in cross-section or end view (but the cross-section and opening are still considered generally rectangular, even though more than four sides are present). This increase can be established in a gradual manner from at least the inside surface of one sidewall 212 of the diffuser to the maximum (e.g., W+15%) at $\frac{1}{4}L_1$ to form a first apex $A_1$ with a subsequent decrease down to width W at its center $L_1/2$, and then a gradual increase to the maximum (e.g., W+15%) at $\frac{3}{4}L_1$ to form a second apex $A_2$, and finally a decrease to width W upon reaching the opposite sidewall 212;

(2) the value of the angle $\beta_i$ is such that $\beta_i$>15°.

Based on the foregoing, it should be appreciated that additional changes or variations can be made to the dimensions of top, bottom, and sidewalls 209, 211, 212 of the diffuser 200 to provide other flow or spray patterns at the outlet 208.

The substantially even or uniform flow having the elongated profile characterized by FIG. 10*a* is of the kind desired in pneumatic triboelectric separation systems in which fine particulate matter is processed to purify a feedstream, such as the system 100 described above and shown in FIGS. 1–7*b*. In this case, it is desirable to distribute the particles uniformly across and to promote smooth controlled flow velocities throughout the electric field zone Z of the separator 10. For powder processing and purification, the flow emanating from the diffuser 200 (or a different diffuser R) may be coupled with a co-flow of gas. As explained above, this co-flow helps to stabilize and smooth the flow within the electric field zone by reducing turbulence and also helps to prevent the particles from bombarding the electrodes.

The flow characterized by FIG. 10*a*, FIG. 10*b* and FIG. 10*c* can be used in other applications. One example includes spray nozzles for applying painting and coatings. By using a diffuser with the flow characteristic or profile of FIG. 10*a*, it is possible to produce a uniform line of paint spray on a surface. By using diffusers having the characteristics of FIGS. 10*b* and 10*c*, different patterns of paint spray could be created. In this latter case, by using a single diffuser or multiple diffusers, it would be possible to paint or coat surfaces in patterns such as stripes. By replacing traditional spray can nozzles, such as those containing paint under pressure, with one of the embodiments of diffusers described above, it is possible to more efficiently coat surfaces. In the case of paint, incorporating a miniaturized diffuser with a co-flow section (with the co-flow either forced through a pressurized source or induced by the flow of paint out of the diffuser) may make it possible to increase the amount of paint placed on a surface during a single application, thereby resulting in less overspray.

Turning back to the separator 10, in some cases, it may be advantageous to combine the effects of an applied electric field with a simultaneously applied magnetic field to improve the results of the separation or purification operation, such as by substituting one of the electrodes 14, 16, or 20 for a magnet. For example, during pneumatic or gas conveyance of particles through a magnetic field, ferromagnetic particles may be deflected away from their original flow direction. In a mixture of magnetite ($Fe_3O_4$) or iron (Fe) with silica ($SiO_2$) or other non-ferromagnetic particles, the ferromagnetic particles would be attracted by the magnetic field whereas the polarity of the electric field can be established such that the non-ferrous particles are deflected away from the magnet.

While examples of several types of particles mixtures are described above, it should be appreciated that these are not considered to limit the inventions disclosed herein to any particular use or application. Other materials that may benefit from the present inventions include, for example, specific minerals in fine-sized mineral mixtures, heavy metal or radioactive components physically mixed in soils or other materials, and ceramics contained in mixtures of ceramics, metals or organic polymers.

The foregoing description of the various embodiments of the invention is provided for purposes of illustration and description. It is not intended to be exhaustive or to limit the invention to the precise form disclosed. Obvious modifications or variations are possible in light of the above teachings. For instance, the third or extension electrode 20 may simply be a non-electrified partition in the case where only a single partition 18 is present. Existing separators or separation cells could also be modified or retrofitted to take advantage of the extension electrode 20 and the other concepts disclosed herein. The embodiments described provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A separator for intended use in at least partially separating at least one species of selectively charged particles from a particle mixture carried by a fluid flow, comprising:

a tubular, elongated body for receiving the fluid flow;

first and second electrodes positioned in or adjacent to the body for creating a first electric field for deflecting selectively charged particles in at least a portion of the body;

a third electrode positioned between the first and second electrodes for creating a second electric field with one of the first and second electrodes; and a first partition defining first and second channels adapted for receiving first and second portions of the fluid flow after entering the first electric field, at least one of the portions of the fluid flow including selectively charged particles deflected by the first electric field;

wherein a direction of an electric field force acting on the selectively charged particles passing through the first electric field is not perpendicular to a direction of gravity.

2. The separator of claim 1 in combination with a diffuser assembly for receiving a fluid medium and creating the fluid flow, comprising:

a second body including a top wall, a bottom wall, and a pair of spaced sidewalls defining an inlet and an outlet; and a tubular nozzle associated with the inlet, the nozzle including a generally circular portion adapted for receiving the fluid medium and a frusto-conical portion extending at least partially along the body toward the outlet for delivering the fluid medium to the second body;

wherein the top wall, boffom wall, and spaced sidewalls define a passageway having a generally rectangular cross-section and an elongated, generally rectangular opening adjacent to the outlet through which the fluid medium passes after exiting the nozzle to form the fluid flow.

3. The separator according to claim 1, wherein the partition prevents selectively charged particles once separated from passing to the other portion of the fluid flow.

4. The separator according to claim 1, wherein the third electrode is electrically coupled or connected to one of the first and second electrodes and a second partition defines a third channel for receiving a third portion of the fluid flow, including selectively charged particles deflected by the third electrode.

5. The separator according to claim 1, wherein one of the first and second electrodes includes a longitudinal dimension and a corresponding dimension of the third electrode is less than the longitudinal dimension of the first or second electrode.

6. The separator according to claim 1, wherein the third electrode is supported by one of the body, the first electrode, and the second electrode.

7. The separator according to claim 1, wherein the direction of the electric field force of at least the first electric field is aligned with and generally parallel to the direction of gravity and generally perpendicular to a direction of fluid flow through the body.

8. The separator according to claim 1, further including a manifold having first and second passageways corresponding to the first and second channels defined by the first partition, each passageway being in communication with a pipe for delivering the particles received in the channel to a collector.

9. The separator according to claim 8, wherein at least one of the first and second passageways includes a non-circular inlet for matching an outlet end of the corresponding channel and a circular outlet for matching with an inlet end of the pipe.

10. The separator according to claim 1, further including a diffuser for positioning in or adjacent to an inlet end of the body to introduce the particle mixture to the electric field.

11. The separator according to claim 10, further including a flow straightener positioned in the inlet end of the body adjacent to the diffuser and adapted for receiving a second flow of fluid devoid of particles.

12. The separator according to claim 1, wherein at least some of the particles in the particle mixture are magnetic, and further including a magnet for creating a magnetic field in at least a portion of the body through which the fluid flow passes for attracting or repelling the magnetic particles.

13. The separator according to claim 1, wherein an angle between the direction of the electric field force of at least the first electric field and the direction of gravity is acute.

14. The separator according to claim 1, wherein the first electric field is positioned at least partially upstream of the partition.

15. The separator according to claim 1, wherein the first electric field is formed by a pair of parallel, differentially charged plates serving as the electrodes.

16. A system for electrostatically separating a first species of selectively charged particles from a particle mixture, comprising:

a feeder for supplying the particle mixture;

a pressurized driving fluid source for supplying a driving fluid for carrying the particle mixture supplied by the feeder;

a separator comprising a tubular, elongated body for receiving the driving fluid carrying the particle mixture, first and second electrodes positioned in or adjacent to the body for creating a first electric field in at least a portion of the body for deflecting selectively charged particles, a third electrode positioned between the first and second electrodes for creating a second electric field with one of the first and second electrodes, wherein the third electrode is electrically coupled to one of the first and second electrodes and includes a longitudinal dimension less than a corresponding dimension of the first and second electrodes, and at least one partition defining first and second channels for receiving first and second portions of the driving fluid after entering the first electric field, wherein a direction of an electrical field force acting on the selectively charged particles passing through the first electric field is not perpendicular to a direction of gravity;

a first collection device for receiving particles collected in the first channel;

a second collection device for receiving particles collected in the second channel; and an induction source in fluid communication with the first and second collection devices for drawing the driving fluid through the system.

17. The system according to claim 16, wherein at least some of the particles in the mixture are magnetic, and further including a magnet for creating a magnetic field in at least a portion of the body through which the fluid flow passes for attracting or repelling the magnetic particles.

18. The system according to claim 16, wherein an angle between the direction of the electric field force of at least the first electric field and the direction of gravity is acute.

19. The system according to claim 16, wherein the separator includes a manifold having first and second passageways corresponding to the first and second channels, each passageway being in communication with a pipe for delivering the particles received in the channels to a selected one of the first and second collection devices.

20. The system according to claim 16, wherein the at least one partition is a first partition and further including a second partition defining a third channel for receiving a portion of the driving fluid including particles deflected by the third electrode.

21. A separator for intended use in at least partially separating at least one species of selectively charged particles from a particle mixture carried by a first fluid flow, comprising:

a tubular, elongated body having an inlet for receiving the fluid flow;

a first electric field for deflecting selectively charged particles in at least a portion of the body;

a diffuser for positioning in or adjacent to the inlet of the body to introduce the particle mixture to the electric field;

a flow straightener positioned in the inlet of the body adjacent to the diffuser and adapted for receiving a second flow of fluid devoid of particles; and a first partition defining first and second channels adapted for receiving first and second portions of the first fluid flow after entering the first electric field, at least one of the portions of the first fluid flow including selectively charged particles deflected by the first electric field;

wherein a direction of an electric field force acting on the selectively charged particles passing through the first electric field is not perpendicular to a direction of gravity.

22. The separator according to claim 21, further including first and second electrodes positioned in or adjacent to the body for creating the first electrical field.

23. The separator according to claim 22, further including a third electrode positioned between the first and second electrodes for creating a second electric field with one of the first and second electrodes.

24. The separator according to claim 23, wherein one of the first and second electrodes include a longitudinal dimension and a corresponding dimension of the third electrode is less than the longitudinal dimension of the first or second electrode.

25. The separator according to claim 21, wherein the direction of the electric field force is aligned with and generally parallel to the direction of gravity and generally perpendicular to a direction of fluid flow through the body.

26. The separator according to claim 21, wherein an angle between the direction of the electric field force and the direction of gravity is acute.

27. The separator according to claim 21, wherein the first electric field is formed by a pair of parallel, differentially charged plates.

28. The separator according to claim 21, wherein the partition prevents selectively charged particles once separated from passing to the other portion of the fluid flow.

29. The separator according to claim 21, wherein the first electric field is formed by a pair of electrodes positioned at least partially upstrearrl of the partition.

30. A separator for intended use in at least partially separating at least one species of selectively charged particles from a particle mixture carried by a fluid flow, comprising:

a tubular, elongated body for receiving the fluid flow;

a first electric field for deflecting selectively charged particles in at least a portion of the body; and a first partition defining first and second channels adapted for receiving first and second portions of the fluid flow after entering the first electric field, at least one of the portions of the fluid flow including selectively charged particles deflected by the first electric field;

wherein a direction of an electric field force acting on the selectively charged particles passing through the first electric field is not perpendicular to a direction of gravity;

wherein at least some of the particles in the particle mixture are magnetic, and further including a magnet for creating a magnetic field in at least a portion of the body through which the fluid flow passes for attracting or repelling the magnetic particles.

31. The separator according to claim 30, further including first and second electrodes positioned in or adjacent to the body for creating the first electrical field.

32. The separator according to claim 31, further including a third electrode positioned between the first and second electrodes for creating a second electric field with one of the first and second electrodes.

33. The separator according to claim 32, wherein the third electrode is electrically coupled or connected to one of the first and second electrodes and a second partition defines a third channel for receiving a third portion of the fluid flow, including selectively charged particles deflected by the third electrode.

34. The separator according to claim 33, wherein one of the first and second electrodes include a longitudinal dimension and a corresponding dimension of the third electrode is less than the longitudinal dimension of the first or second electrode.

35. The separator according to claim 30, wherein the direction of the electric field force is aligned with and generally parallel to the direction of gravity and generally perpendicular to a direction of fluid flow through the body.

36. The separator according to claim 30, wherein an angle between the direction of the electric field force and the direction of gravity is acute.

37. The separator according to claim 30, wherein the first electric field is formed by a pair of parallel, differentially charged plates.

38. The separator according to claim 30, wherein the partition prevents selectively charged particles once separated from passing to the other portion of the fluid flow.

39. The separator according to claim 30, wherein the first electric field is formed by a pair of electrodes positioned at least partially upstream of the partition.

40. A system for electrostatically separating a first species of selectively charged particles from a particle mixture, comprising:

a feeder for supplying the particle mixture;

a pressurized driving fluid source for supplying a driving fluid for carrying the particle mixture supplied by the feeder;

a separator comprising a tubular, elongated body for receiving the driving fluid carrying the particle mixture, a first electric field in at least a portion of the body for deflecting selectively charged particles, and at least one partition defining first and second channels for receiving first and second portions of the driving fluid after entering the first electric field, wherein a direction of an electrical field force acting on the selectively charged particles passing through the first electric field is not perpendicular to a direction of gravity;

a first collection device for receiving particles collected in the first channel;

a second collection device for receiving particles collected in the second channel; and an induction source in fluid communication with the first and second collection devices for drawing the driving fluid through the system;

wherein at least some of the particles in the mixture are magnetic, and further including a magnet for creating a magnetic field in at least a portion of the body through which the fluid flow passes for attracting or repelling the magnetic particles.

41. The separator according to claim 40 wherein the first electric field is formed by a pair of parallel, differentially charged plates.

42. The separator according to claim 40 wherein the partition prevents selectively charged particles once separated from passing to the other portion of the fluid flow.

43. The separator according to claim 40, wherein the first electric field is formed by a pair of electrodes positioned at least partially upstream of the partition.

44. A separator for intended use in at least partially separating at least one species of selectively charged particles from a particle mixture carried by a fluid flow, comprising:

a diffuser assembly for receiving a fluid medium and creating the fluid flow, comprising a second body including a top wall, a bottom wall, and a pair of spaced sidewalls defining an inlet and an outlet, a tubular nozzle associated with the inlet, the nozzle including a generally circular portion adapted for receiving the fluid medium and a frusto-conical portion extending at least partially along the body toward the outlet for delivering the fluid medium to the second body, wherein the top wall, bottom wall, and spaced sidewalls define a passageway having a generally rectangular cross-section and an elongated, generally rectangular opening adjacent to the outlet through which the fluid medium passes after exiting the nozzle to form the fluid flow from the diffuser;

a tubular, elongated body for receiving the fluid flow;

a first electric field for deflecting selectively charged particles in at least a portion of the body;

a first partition defining first and second channels adapted for receiving first and second portions of the fluid flow after entering the first electric field, at least one of the portions of the fluid flow including selectively charged particles deflected by the first electric field;

wherein a direction of an electric field force acting on the selectively charged particles passing through the first electric field is not perpendicular to a direction of gravity.

* * * * *

UNITED STATES PATENT AND TRADEMARK OFFICE

CERTIFICATE OF CORRECTION

PATENT NO. : 7,086,535 B2
APPLICATION NO. : 10/438376
DATED : August 8, 2006
INVENTOR(S) : John M. Stencel and Tapiwa Zabron Gurupira It is certified that error appears in the above-identified patent and that said Letters Patent is hereby corrected as shown below:

Column 19, claim 29, line 9, please replace “upstrearrl” with -- upstream --.

Signed and Sealed this

Twenty-eighth Day of November, 2006

JON W. DUDAS
*Director of the United States Patent and Trademark Office*